US006215509B1

(12) United States Patent
Nishikawa et al.

(10) Patent No.: US 6,215,509 B1
(45) Date of Patent: Apr. 10, 2001

(54) NON-IMPACT RECORDING METHOD AND CONDUCTIVE RECORDING MEDIUM

(75) Inventors: Hisashi Nishikawa, Numazu; Toshihiro Ichinohe, Shizuoka; Mitsuharu Endo, Susono, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/065,727

(22) Filed: Apr. 24, 1998

(30) Foreign Application Priority Data

Apr. 24, 1997 (JP) ..... 9-107203
Mar. 10, 1998 (JP) ..... 10-58274

(51) Int. Cl.[7] ..... B41J 2/32; B41J 2/385; B41J 2/39; B41J 2/42

(52) U.S. Cl. ..... 347/199

(58) Field of Search ..... 347/199, 114, 347/221

(56) References Cited

U.S. PATENT DOCUMENTS 4,305,082 * 12/1981 Kusakawa et al. .
4,511,877 * 4/1985 Nishikawa et al. .
4,967,231 * 10/1990 Hosoya et al. .
5,005,993 * 4/1991 Ohno et al. .
5,032,873 * 7/1991 Nishikawa .
5,051,332 * 9/1991 Hosoya et al. .
5,066,982 * 11/1991 Hosoya et al. .
5,110,705 * 5/1992 Hosoya et al. .
5,115,279 * 5/1992 Nishikawa et al. .
5,323,215 * 6/1994 Ohtaka et al. .
5,422,706 * 6/1995 Tsunemi et al. .

FOREIGN PATENT DOCUMENTS 52-73048 * 6/1977 (JP) .
55-109692 * 8/1980 (JP) .
64-55280 * 3/1989 (JP) .

* cited by examiner

*Primary Examiner*—Huan Tran
(74) *Attorney, Agent, or Firm*—Oblon, Spivak, McClelland, Maier & Neustadt, P.C.

(57) ABSTRACT

A non-impact recording method is provided in which 3 to 4 or more copying sheets can be made through a non-impact system and further a small-sized printer which can be installed in portable type information terminal equipment can be formed. A non-impact recording method is also provided in which when electricity is applied between separate electrodes and a common electrode oppositely contacted with each other and arranged against both surfaces of a conductive recording medium, a recording image is formed by heat energy generated by the conductive recording media, wherein a plurality of the conductive recording media are overlapped with each other and volume resistivities of each of the overlapped conductive recording media are substantially the same to each other or decreased as they may move toward the common electrode.

44 Claims, 20 Drawing Sheets

NON-IMPACT RECORDING METHOD AND CONDUCTIVE RECORDING MEDIUM

BACKGROUND OF THE INVENTION

1. Field of the Invention

This invention relates to a non-impact recording method in which either characters or images are formed in response to an image signal with Joule heat generated by a selective electrical energization of either a conductive recording medium or a recorded member, and more particularly a non-impact recording method in which either the same characters or images can be formed concurrently on a plurality of overlapped conductive recording media. This invention also relates to a conductive recording medium for use in the above non-impact recording method.

2. Description of the Prior Art

In the prior art, as means for forming, copying and recording the same characters or images concurrently on a plurality of recording media, an impact dot type printer is frequently used. In this impact dot type printer, the copying and recording can be attained by applying a mechanical striking force against the recording medium to generate color in a pressure-sensitive coloring agent coated on a substrate of the recording medium or by transferring pressure-sensitive transfer ink to another recording medium.

However, such an impact dot type printer as described above still has some problems of reducing vibration or noise generated by mechanical striking action, reducing its size, weight and reducing amount of electrical power consumption caused by a capacitive restriction of a power supply of battery cell which are required in the case that the printer is to be assembled into portable type information equipment, in particular.

In view of the foregoing, as means for attaining concurrently a copying and a recording on a plurality of overlapped recording media or recorded members in a so-called non-impact dot type printer, a thermal processing type technology has already been disclosed in the gazettes of Japanese Patent Laid-Open Nos. Sho 52-115229 and 56-75894, and in particular, an ink-jet technology has already been disclosed in the gazettes of Japanese Patent Laid-Open Nos. Sho 51-24833 and 55-69463 and Japanese Patent Publication No. Hei 2-37307.

At first, the technology described in the gazette of Japanese Patent Laid-Open No. Sho 52-115229 as a thermal processing system is constructed such that there are provided a first recording sheet having at a front surface of a substrate a thermo-sensitive coloring layer and at a rear surface of it both an ink immersion preventive layer and a thermal fusing ink layer and a second transferring recording sheet overlapped on the recording sheet, wherein a thermal head is contacted with the surface of the first recording sheet to cause the thermo-sensitive coloring layer to generate color and form an image and concurrently the thermal fusing ink at the rear surface is transferred to the second recording sheet so as to attain a copied image. A technology concerning an improvement of the recording medium used in such a copying and recording system is already described in the gazette of Japanese Patent Laid-Open No. Sho 56-75894.

Then, a technology described in the gazette of Japanese Patent Laid-Open No. Sho 51-24833 as an ink-jet system is operated such that a part of liquid ink particle struck against the first recording sheet having a high ink permeation is permeated and absorbed in the second recording sheet having a high ink permeation overlapped on its rear surface so as to attain a copied image. In addition, the technology described in the gazette of Japanese Patent Laid-Open No. Sho 55-69463 is operated such that the heated ink particle is adhered to the first recording sheet and then a copied image is produced by a thermo-sensitive recording system subsequent to the second recording sheet overlapped on the rear surface thereof by heat energy carried by the ink particle. Additionally, the technology described in the gazette of Japanese Patent Publication No. Hei 2-37307 is operated such that liquid droplets of volatile coloring induced solvent is adhered to the first recording medium coated with coloring substance reacted with the liquid droplets, the residual non-reacted coloring induced solvent is reached to the second recording medium through the first recording medium and the coloring substance coated on the second recording medium is colored to form a copied image.

Disadvantages of the above mentioned art are described below. In a commodity distributing business or a material handling field or the like, there are much amount of demand for making a concurrent copying and recording of three to four or more overlapped recording media. In the thermal driving system disclosed in the gazette of Japanese Patent Laid-Open No. Sho 52-115229 indicated in the prior art, there is a certain limitation in heat energy capable of being supplied by the thermal head and there remain many technical problems which must be resolved such as a lack of concentration of image or lack of fineness of image caused by a heat conductivity of the recording medium and a thermal dispersion during its conduction, and a reduction in an image forming speed or the like.

In addition, the ink-jet type recording system described in the gazettes of Japanese Patent Laid-Open No. Sho 51-24833 and Japanese Patent Publication No. Sho 2-37307 indicated in the prior art have some problems of permeation of either liquid ink or coloring induced solvent through the recording medium or dispersion of either liquid ink or coloring induced solvent in the recording medium and the recording system described in the gazette of Japanese Patent Laid-Open No. Sho 55-69463 has a certain limitation in an amount of heat energy carried by ink particles and as for the application requiring copying of 3 to 4 or more sheets, there remain many technical problems in view of their practical applications.

SUMMARY OF THE INVENTION

It is an object of the present invention to provide a non-impact type recording method in which it is possible to perform a copying and recording of more than 3 to 4 sheets in the non-impact type system.

It is another object of the present invention to provide a non-impact type recording method capable of being applied to a bill printer which can be mounted in portable type information terminal equipment.

It is further object of the present invention to provide a non-impact type recording method capable of recording having a high degree of clearness.

It is further object of the present invention to provide a non-impact type recording method capable of preventing a recording concentration of the conductive recording medium contacted with the recording head and/or the platen from being decreased.

It is further object of the present invention to provide a non-impact type recording method capable of keeping an electrical contact between the separate electrode (and/or the common electrode) and the conductive recording medium in a superior condition.

It is further object of the present invention to provide a non-impact type recording method capable of restricting a wearing of the separate electrode caused by a contact sliding of it with the conductive recording medium.

It is further object of the present invention to provide a conductive recording medium for use in the above non-impact type recording method.

Present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other and volume resistivities of each of the overlapped conductive recording media are substantially the same to each other; and applying electricity between the separate electrodes and the common electrode.

Accordingly, since the conductive recording medium has a conductive characteristic, even if a plurality of these conductive recording media are kept at their overlapped state, an electrical current flows in a direction of thickness of each of the conductive recording media through a separate electrode and a common electrode contacted with both front and rear surfaces, resulting in that a part striking against an electrical current flow passage generates heat by itself to cause a thermo-sensitive recording medium to generate color or a thermo-sensitive transfer ink layer is transferred to another medium, thereby the same content can be recorded concurrently and further since volumetric resistivity of each of the conductive recording media and further since volumetric resistivity of each of the conductive recording media is approximately the same to each other, the current passage is not dispersed within the conductive recording media when electricity is applied and then a recording having a high degree of clearness can be carried out.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other and volume resistivities of each of the overlapped conductive recording media are decreased as it may approach toward the common electrode; and applying electricity between the separate electrodes and the common electrode.

Accordingly, since the conductive recording medium has a conductive characteristic, even if a plurality of these conductive recording media are kept at their overlapped state, an electrical current flows in a direction of thickness of each of the conductive recording media through a separate electrode and a common electrode contacted with both front and rear surfaces, resulting in that a part striking against an electrical current flow passage generates heat by itself to cause a thermo-sensitive coloring layer to generate color or a thermo-sensitive transfer ink layer is transferred to another medium, thereby the same content can be recorded concurrently and further since volume resistivity of each of the conductive recording media is decreased as it may approach toward the common electrode, the current passage is not dispersed within the conductive recording media when electricity is applied and then a recording having a high degree of clearness can be carried out.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the separate electrodes contacted with the overlapped conductive recording media are formed by a plurality of conductive films which are electrically independent from each other; and applying electricity between the separate electrodes and the common electrode.

Accordingly, a film thickness of the conductive film can be made thin to reduce a heat capacity and a heat conduction, thereby it is possible to restrict heat generated in the conductive recording medium from flowing out to the recording head through the separate electrode and further it is possible to prevent a recording concentration of the conductive recording medium contacted with the recording head from being decreased.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the separate electrodes contacted with the overlapped conductive recording media are formed by dividing conductive films stacked on a surface of a metallic supporting member through electrical and thermal insulating layers into a plurality of segments; and applying electricity between the separate electrodes and the common electrode.

Accordingly, a film thickness of the conductive film is made thin to reduce a heat capacity and a heat conduction, thereby it is possible to restrict heat generated in the conductive recording medium from flowing out to the recording head through the separate electrode and further it is possible to prevent a recording concentration of the conductive recording medium contacted with the recording head from being decreased.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the separate electrodes contacted with the overlapped conductive recording media are formed by dividing conductive films stacked on a surface of a supporting member having an electrical insulating characteristic and a thermal insulating characteristic into a plurality of segments; and applying electricity between the separate electrodes and the common electrode.

Accordingly, a film thickness of the conductive film is made thin to reduce a heat capacity and a heat conduction, thereby it is possible to restrict heat generated in the conductive recording medium from flowing out to the recording head and further it is possible to prevent a recording concentration of the conductive recording medium contacted with the recording head from being decreased.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the separate electrodes contacted with the overlapped conductive recording media are formed by a conductive film pattern stacked on the surface of a synthetic resin film and then this synthetic resin film is adhered to a supporting mechanism member; and applying electricity between the separate electrodes and the common electrode.

Accordingly, a film thickness of the conductive film is made thin to reduce a heat capacity and a heat conduction, thereby it is possible to restrict heat generated in the conductive recording medium from flowing out to the recording head and further it is possible to prevent a recording concentration of the conductive recording medium contacted with the recording head from being decreased.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, a plurality of separate electrodes contacted with the overlapped conductive recording media are formed by a conductive film pattern of divided conductive films on the surface of a synthetic resin film and then the synthetic resin film is adhered to a supporting mechanism member through a member having rubber resilience; and applying electricity between the separate electrodes and the common electrode.

Accordingly, a film thickness of the conductive film is made thin to reduce a heat capacity and a heat conduction, thereby it is possible to restrict heat generated in the conductive recording medium from flowing out to the recording head and further it is possible to prevent a recording concentration of the conductive recording medium contacted with the recording head from being decreased and to keep an electrical contact between the separate electrode and the conductive recording medium in a superior condition.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the common electrode contacted with the overlapped conductive recording media is formed by conductive material having its volume resistivity lower than volume resistivity of the conductive recording medium contacted with the common electrode; and applying electricity between the separate electrodes and the common electrode.

Accordingly, an electrical current flowing through a plurality of overlapped conductive recording media can be concentrated near a straight line connecting the separate electrode with the common electrode in the shortest distance.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the common electrode contacted with the overlapped conductive recording media is formed by conductive material whose volume resistivity is lower than a volume resistivity of the conductive recording medium contacted with the common electrode and whose heat conductivity is not more than 1 $W \cdot m^{-1} \cdot K^{-1}$; and applying electricity between the separate electrodes and the common electrode.

Accordingly, an electrical current flowing through a plurality of overlapped conductive recording media can be concentrated near a straight line connecting the separate electrode with the common electrode and further since a heat conductivity of the common electrode is low, the heat generated in the conductive recording medium can be prevented from being flowed out toward the common electrode and further it is possible to prevent a recording concentration of the conductive recording medium contacted with the common electrode from being decreased.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the common electrode contacted with the overlapped conductive recording media is formed on the surface of a supporting mechanism member by a conductive layer whose volumetric resistivity is lower than a volume resistivity of the conductive recording medium contacted with the common electrode and whose heat conductivity is not more than 1 $W \cdot m^{-1} \cdot K^{-1}$; and applying electricity between the separate electrodes and the common electrode.

Accordingly, an electrical current flowing through a plurality of overlapped conductive recording media can be concentrated near a straight line connecting the separate electrode with the common electrode in the shortest distance and the heat generated in the conductive recording medium can be prevented from being flowed out toward the common electrode and further it is possible to prevent a recording concentration of the conductive recording medium contacted with the common electrode from being decreased.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the common electrode contacted with the overlapped conductive recording media is formed on the surface of a supporting mechanism member by a conductive film whose volume resistivity is lower than that of the conductive recording medium contacted with the common electrode through a thermal insulating layer having a heat conductivity not more than 1 $W \cdot m^{-1} \cdot K^{-1}$; and applying electricity between the separate electrodes and the common electrode.

Accordingly, an electrical current flowing through a plurality of overlapped conductive recording media can be concentrated near a straight line connecting the separate electrode with the common electrode in the shortest distance and since the conductive film has a low heat conductivity and a thermal insulating layer is present, it is possible to restrict heat generated in the conductive recording medium from flowing out toward the common electrode and further to prevent a recording concentration of the conductive recording medium contacted with the common electrode from being decreased.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, either a single or a plurality of separate electrodes contacted with one side of the overlapped conductive recording media are transferred along the conductive recording media while the common electrode are being press contacted with another side of the conductive recording media; and applying electricity between the separate electrodes and the common electrode.

Accordingly, when the recording head moves at a position where it is oppositely faced against the common electrode, it is possible to form the recording image having the same content concurrently at each of the conductive recording media.

Another aspect of the present invention provides a non-impact recording method, a recording image is formed on a conductive recording medium by heat energy, comprising the steps of:

bringing the conductive recording medium into contact between separate electrodes and a common electrode, the conductive recording medium is formed with a plurality of the conductive recording media to be overlapped with each other, the common electrode contacted with one surface of the overlapped conductive recording media move the conductive recording medium while the separate electrodes are being press contacted with another side of the conductive recording medium; and applying electricity between the separate electrodes and the common electrode.

Accordingly, when the common electrode transports the conductive recording medium, it is possible to form the recording image having the same content concurrently at each of the conductive recording media at a position opposing against the separate electrode.

Another aspect of the present invention provides a conductive recording medium, comprising:

a plurality of conductive recording sheets, volume resistivities of each of the conductive recording sheets are substantially the same to each other; and means for combining a plurality of the conductive recording sheets to be overlapped with each other.

Another aspect of the present invention provides a conductive recording medium, comprising:

a plurality of conductive recording sheets, volume resistivities of each of the conductive recording sheets are different each other; and means for combining a plurality of the conductive recording sheets to be overlapped with each other as volume resistivities of each of the overlapped conductive recording sheets are decreased.

DESCRIPTION OF THE PREFERRED EMBODIMENTS

Figure 1A:
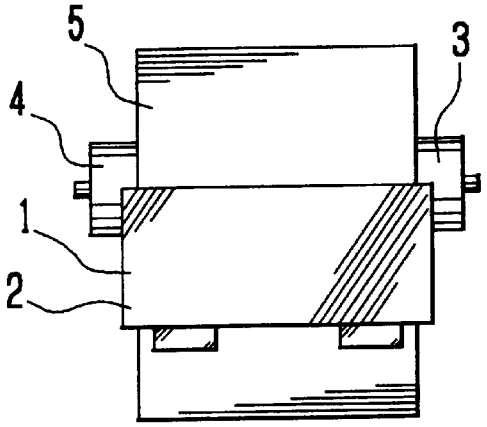
FIG. 1 illustrates a first preferred embodiment of the present invention, wherein (A) is a top plan view of a printer, and (B) is a side elevational view thereof.
Figure 1B:
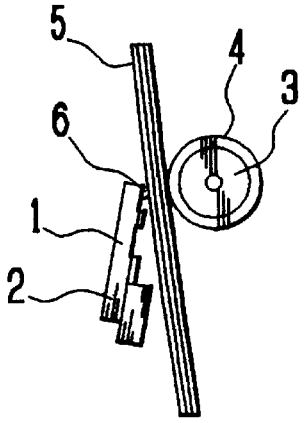

Referring now to FIGS. 1 to 9, a first preferred embodiment of the present invention will be described as follows. At first, a system shown in FIG. 1 is a printer 1, wherein the printer 1 is comprised of an electrical energizing print head 2 and a platen roller 3. At the surface of the platen roller 3 is formed a common electrode 4 which is continuous over its entire surface. In addition, the electrical energizing print head 2 is biased by a spring not shown toward the platen roller 3 and contacted against recording media 5 acting as a plurality of overlapped conductive recording media, wherein many separate electrodes 6 are arranged in one row at the contacted surface.

Figure 2:
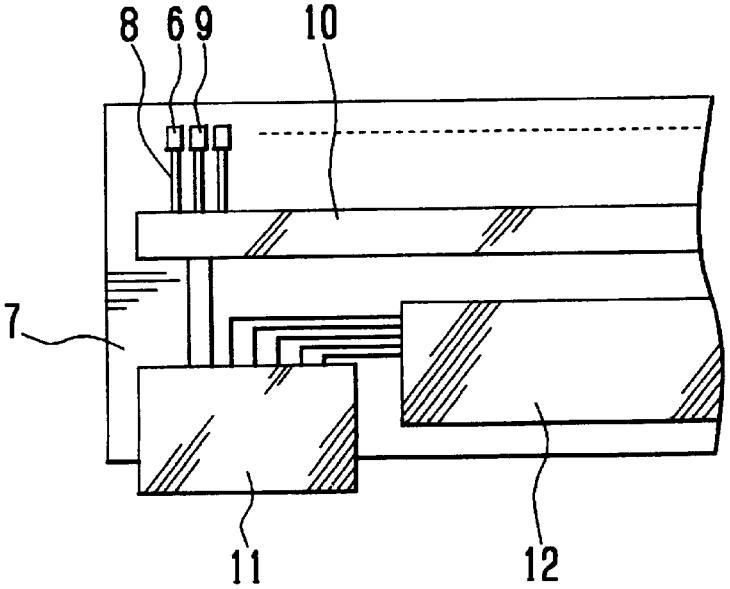
FIG. 2 is a top plan view for showing an electrically energized print head.

In FIG. 2 is illustrated a detailed view of the electrical energizing print head 2, wherein many groups 8 of metallic conductor patterns are formed on an insulating substrate 7 made of alumina and an anti-wearing layer 9 of metallic tungsten is formed at the part of one end of each of the groups 8 of conductive pattern of the separate electrodes 6 contacted with the recording medium 5, and one end of each of the groups 10 of switch elements is connected to the other end of each of the groups 8 of the conductor patterns. The other end of each of the groups 10 of the switch elements is connected to a power supply for an external electrical energizing current (not shown) through a coupling connector 11. In addition, to the coupling connector 11 is connected to an IC 12 for use in controlling ON or OFF of the groups 10 of switches in correspondence with signals of characters or images.

Figure 3:
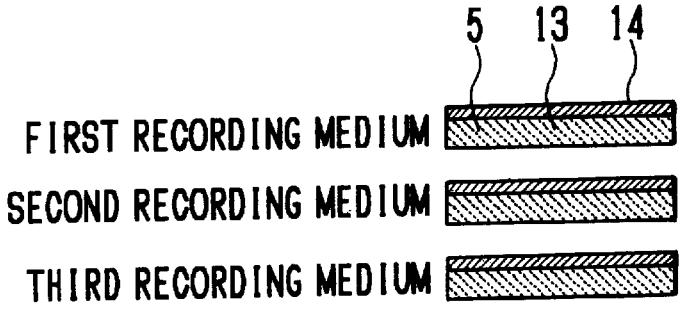
FIG. 3 is a side elevational view in longitudinal section for showing three-sheet type recording medium.
Figure 4:
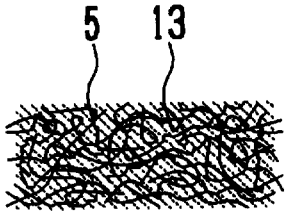
FIG. 4 is a side elevational view for showing a substrate of a recording medium.
Figure 5:
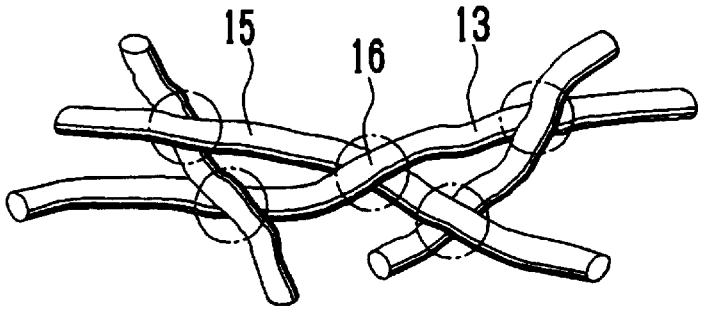
FIG. 5 is an illustrative view for showing a cellulose of a substrate.

Then, as shown in FIG. 3, the recording medium 5 is made such that a conductive thermo-sensitive coloring layer 14 is formed at the surface of a conductive substrate 13. As shown in FIG. 4, the substrate 13 is made of conductive non-electrolytic plating sheet produced such that metal of Ni (nickel) is adhered by non-electrolytic plating process with Pd (palladium) being applied as catalyst to the surface of each of celluloses 15 prepared from their surface layer to their inner layer and stacked. Due to this fact, as shown in FIG. 5, contact points 16 of each of celluloses 15 (portions enclosed by round circles in the figure) are electrically connected by nickel plating layers. The substrate 13 may have a conductive characteristic of about 10 to $10^{-2}$ Ω·cm of volume inherent resistivity in accordance with immersion time in plating liquid or other conditions.

The substrate 13 as attained above is colored and in the case that characters or images are directly formed on the surface of the substrate, it is desirable that substances, although not shown, mixed with and kneaded by fine powder of Ag (silver) for applying conduction to binder having acrylic resin dissolved in solvent and fine powder of $TiO_2$ (titanium oxide) for making a surface white, for example, are coated on the surface of the substrate 13, dried there and a conductive layer having approximately white color is additionally formed. In this case, it is desirable that a relation between the substrate 13 and the white conductive layer is set such that volume inherent resistivity of a white conductive layer is in general approximately equal to volume inherent resistivity of the substrate 13 and in the case that volume inherent resistivity of the white conductive layer is lower than that of the substrate, it is sometimes found that an energized current is dispersed to apply an adverse effect against an accurate fine degree in printing. In addition, in the case that a plurality of substrates (a plurality of conductive recording sheets) are overlapped from each other, an adverse effect may be applied to an accurate fine degree in printing even if volume inherent resistivity of the white conductive layer is higher than that of the substrate.

Then, the aforesaid conductive thermo-sensitive coloring layer 14 is a thermo-sensitive coloring agent having electrical conduction by mixing electrical conductive fine powder. For example, fine powder of Ag (silver) for applying electrical conduction is added to substance in which CVL (crystal violet lactone) acting as colorless dye, bisphenol A acting as developer, PVA (polyvinylalcohol) acting as adhesive agent, and sensitizer or the like are dispersed or dissolved in solvent, such materials as above are coated on the surface of the substrate 13 and dried to form a conductive thermo-sensitive coloring layer 14. It is desirable that volume inherent resistivity of the conductive thermo-sensitive coloring layer 14 is approximately equal to volume inherent resistivity of the substrate. Additionally, as for application in which color of the substrate 13 seen through the conductive thermo-sensitive coloring layer 14 provides a certain problem, substance in which titanium white is added and mixed in the conductive thermo-sensitive coloring layer 14 is used.

Figure 6:
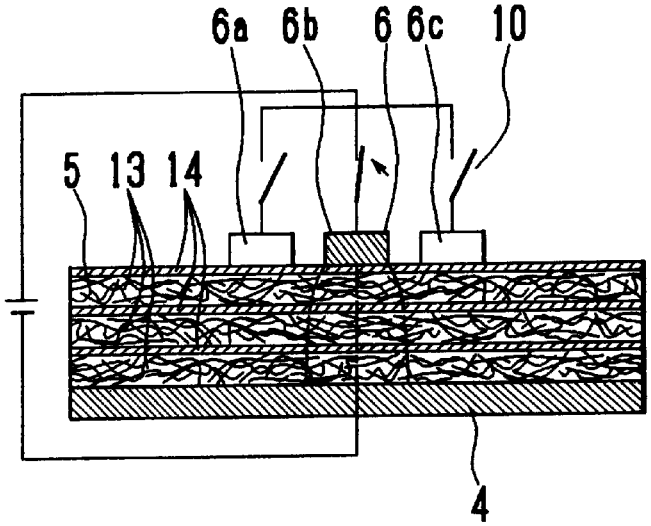
FIG. 6 is side elevational view in longitudinal section for showing an electrically energized state under an arrangement in which a recording medium is arranged between electrodes.
Figure 7:
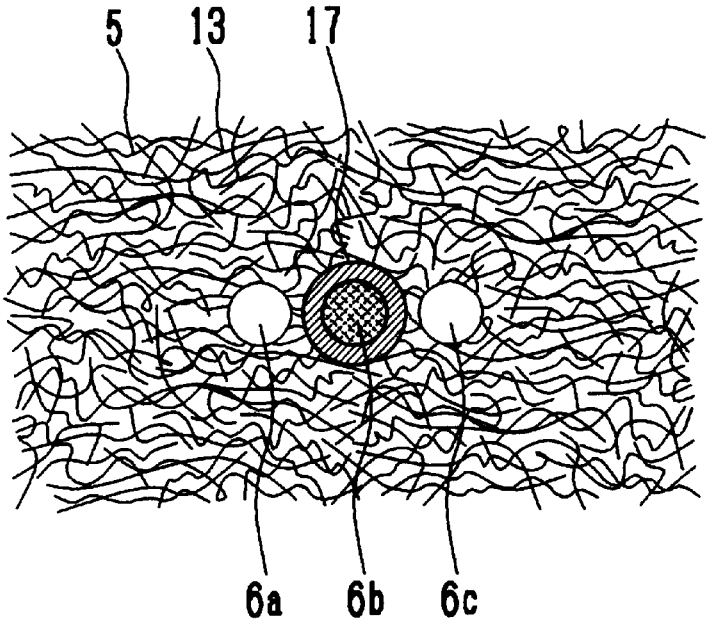
FIG. 7 is a top plan view for showing a colored recording medium.
Figure 8A:
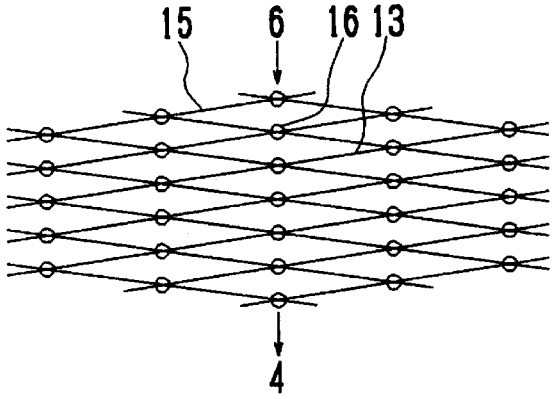
FIG. 8 illustrates a configuration for electrically energizing for a substrate of a recording medium, wherein (A) illustrates an arrangement of cellulose and (B) is a graph for showing a heat generated state.
Figure 8B:
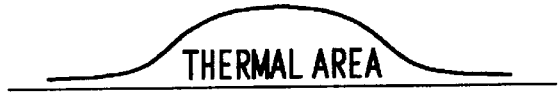

In such a configuration as described above, when either characters or images are printed on the recording medium 5, three recording media 5 are overlapped and combined as shown in FIG. 6 and set between the electrical energizing print head 2 and the platen roller 3. Due to this fact, the separate electrode 6 of the electrical energizing print head 2 is contacted with the front surface of the three recording media 5 and the common electrode 4 is contacted with the rear surface of it. Therefore, an application of voltage for the separate electrode 6 is controlled by the IC 12 and the group 10 of the switch elements in accordance with the characters or images to be printed, and a current indicated by a dotted line is flowed at the part of the separate electrode 6 to which voltage is applied, for example, between the separate electrode 6*b* and the common electrode 4 in FIG. 6. Since no voltage is applied to the separate electrodes 6*a,* 6*c* adjacent to the separate electrode 6*b,* the substrate 13 of the recording medium 5 and the conductive thermo-sensitive coloring layer 14 may generate heat by the current flowed between the separate electrode 6*b* and the common electrode 4, the conductive thermo-sensitive coloring layer 14 may produce color by this heat energy so as to form a dot 17 as shown in FIG. 7. This dot 17 does not interfere with the adjoining separate electrodes 6*a,* 6*c*. However, in the case that it is necessary to form dots also at these separate electrodes 6*a,* 6*c,* a voltage is applied in a displaced timing in respect to a timing of application of voltage to the separate electrode 6*b*. Thus, its practical range is indicated for example, wherein in the case that a mean length of the cellulose 15 constituting the substrate 13 is about 1 mm, a pitch of the separate electrode 6 of the electrical energizing print head 2 is about 0.17 mm (corresponding to 150 dpi), a shape of a part of the separate electrode 6 contacted with the recording medium 5 is a circle and its diameter is about 0.1 mm, a result of experiment shows that the coloring caused by electrical energization as described above keeps the state of the dot 17 shown in FIG. 7 and it is found that it is not dispersed in a circumferential area in such a degree as one it may provide an adverse effect against an accurate fine degree in printing of this level. As shown in FIG. 8(*a*), this is assumed to be considered that the electrical energizing current flowed from the separate electrode 6 is distributed in such a way that its synthetic resistance may become a minimum value through each of the non-electrolytic plated celluloses 15 and each of their contact points 16 and reaches the common electrode 4. Due to this fact, as shown in FIG. 8(*b*), there is a distribution of generated heat and the dot 17 is formed in response to the distribution of generated heat.

Then, an example of application of the preferred embodiment of the present invention will be described in reference to FIG. 9. In this case, an overlapped bill 18 formed by three recording media 5 is used. This overlapped bill 18 is provided with a pre-printed region 19 in which some common items are printed in advance when a bill sheet is made, a printing region 20 to be printed by the printer 1 when it is used and a manuscript region 21 in which a signature is manually written. Then, all the three recording media 5 are made such that the conductive thermo-sensitive coloring layer 14 is formed at the surface of the substrate 13, the second recording medium 5 and the third recording media 5 except the upper-most layer are provided with pressure-sensitive coloring layers 22 to form the manuscript region 21. Due to this fact, the characters or images required in the printing region 20 are printed by the printer 1 and a manuscript is written in the manuscript region 21 by a ball-point pen or the like, thereby the characters or images having the same content are recorded concurrently in the three recording media 5.

Figure 10:
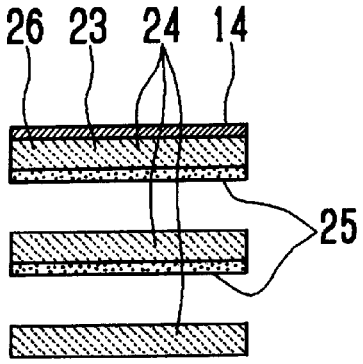
FIG. 10 is a side elevational view for showing an overlapped bill in which a second preferred embodiment of the present invention is shown.
Figure 11:
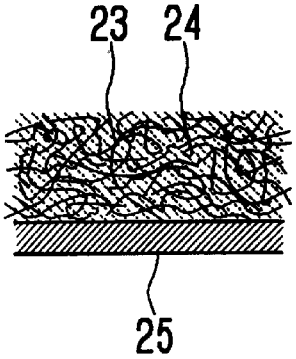
FIG. 11 is a side elevational view for showing a recording medium in which a conductive thermo-sensitive transfer ink layer is formed.
Figure 12:
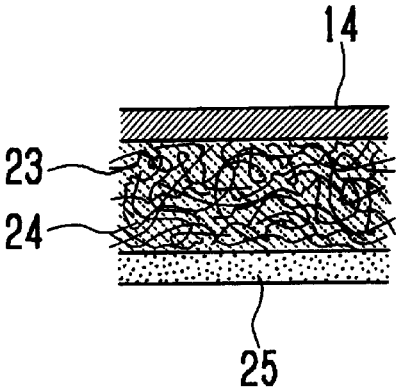
FIG. 12 is a side elevational view for showing a recording medium in which each of a conductive thermo-sensitive coloring layer and a conductive thermo-sensitive transfer ink layer is formed at its upper surface and lower surface, respectively.

Referring to FIGS. 10 to 13, a second preferred embodiment of the present invention will be described as follows. A recording medium 23 in the preferred embodiment of the present invention is made such that thermo-sensitive transfer ink is coated on the rear surface of a substrate 24 to form a conductive thermo-sensitive transfer ink layer 25. Then, in order to form an overlapped bill 26 having three-layer structure, the recording medium 23 of the lower-most layer is only the substrate 24, the recording medium 23 of the second layer is one in which the lower surface of the substrate 24 is formed with the conductive thermo-sensitive transfer ink layer 25, the recording medium 23 of the upper-most layer is one in which the lower surface of the substrate 24 is formed with the conductive thermo-sensitive transfer ink layer 25 and its upper surface is formed with the conductive thermo-sensitive coloring layer 14 applied in the first preferred embodiment. In this case, the medium shown in FIG. 11 is the recording medium 23 of the second layer and the medium shown in FIG. 12 is the recording medium 23 of the upper-most layer.

The aforesaid conductive thermo-sensitive transfer ink layer 25 is formed by thermo-sensitive transfer ink having electrical conduction by mixing conductive fine powder. For example, this is formed such that carnauba wax and ester wax acting as binder agent, powder of carbon black acting as coloring agent and electrical conduction applying agent are mixed with and kneaded with lubricant oil heated and melted as softening agent, coated at the surface of the substrate 24, cooled and hardened. It is desirable that volume inherent resistivity of the conductive thermo-sensitive transfer ink layer 25 is also approximately equal to volume inherent resistivity of the substrate 24.

Figure 9A:
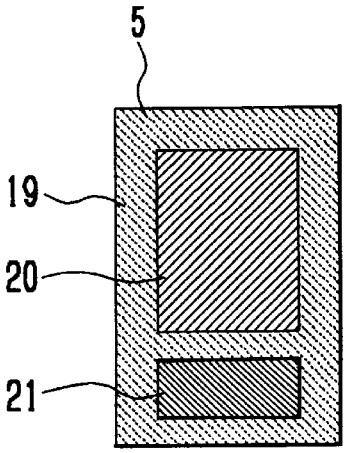
FIG. 9 shows a structure of an overlapped bill, wherein (A) is a top plan view and (B) is a side elevational view.
Figure 9B:
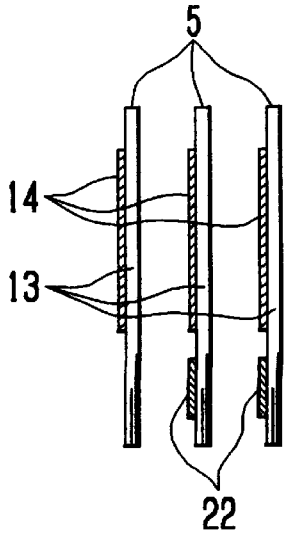
Figure 13A:
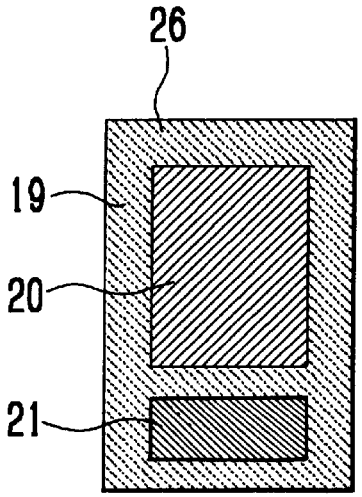
FIG. 13 illustrates the structure of an overlapped bill, wherein (A) is a top plan view and (B) is a side elevational view.
Figure 13B:
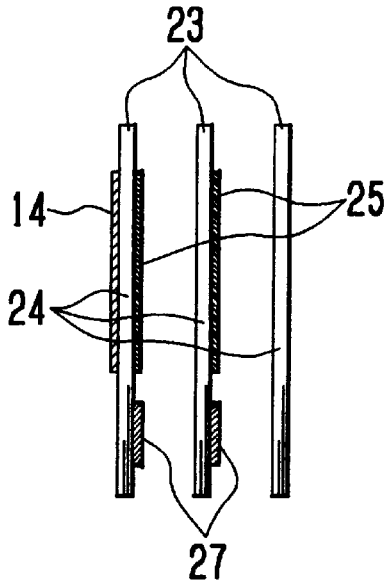
Figure 14A:
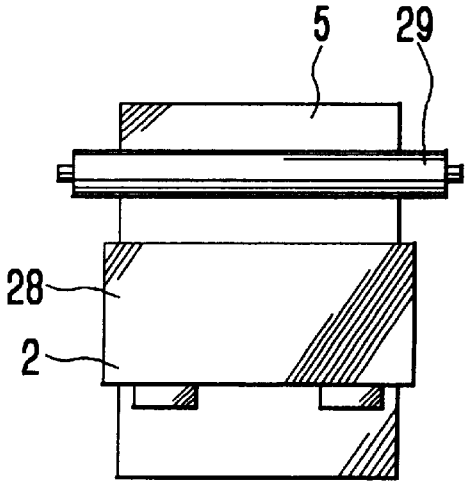
FIG. 14 illustrates a third preferred embodiment of the present invention, wherein (A) is a top plan view of a printer and (B) is a side elevational view thereof.
Figure 14B:
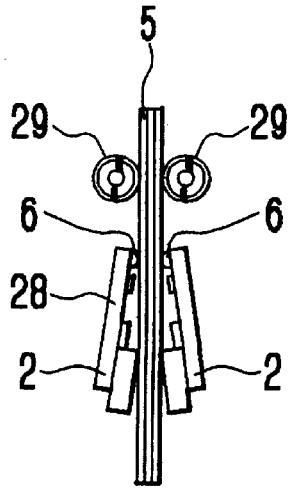
Figure 15:
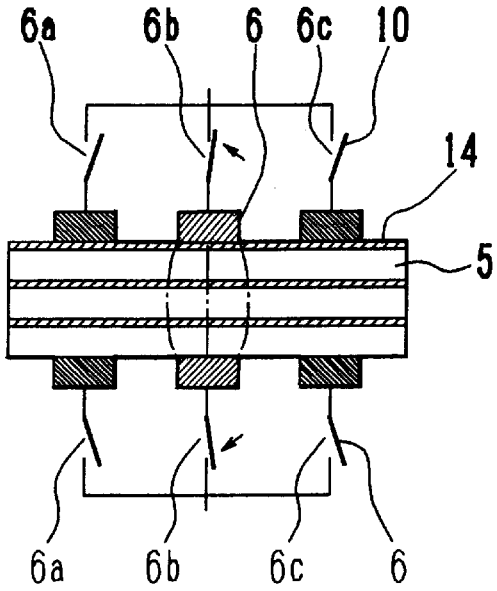
FIG. 15 is a partial sectional view for showing an electrical energized state.

In this case, a practical shape of the overlapped bill 26 is one shown in FIG. 13 and it has a pre-printing region 19, a printing region 20 and a manuscript region 21 in the same manner as that shown in the aforesaid FIG. 9. Provided that as regard the manuscript region 21, it is also applicable that it may be formed by the pressure-sensitive coloring layer 22 in the same manner as that shown in FIG. 9. However, in the preferred embodiment of the present invention, the pressure-sensitive transfer ink layers 27 are formed at the rear surfaces of the recording medium 23 of the upper-most layer and the recording medium 23 of the second layer.

With such an arrangement as above, the overlapped bill 26 is set such that characters or images are printed in the printing region 20 by the printer 1. However, the substrate 24, the conductive thermo-sensitive coloring layer 14 and the conductive thermo-sensitive transfer ink layer 25 of the recording medium 23 generate heat by an electrical energization between the separate electrode 6 and the common electrode 4, thereby the conductive thermo-sensitive coloring layer 14 generates color and concurrently ink of the conductive thermo-sensitive transfer ink layer 25 is fused and adhered in dot form to the opposing substrate 24 so as to form characters or images. Then, as for the manuscript region 21, characters or the like are recorded by manually by a ball-point pen or the like. With such an arrangement as above, ink of the pressure-sensitive transfer ink layer 27 is transferred to the opposing substrate 24 so as to perform a recording thereat.

Referring to FIGS. 14 to 17, a third preferred embodiment of the present invention will be described as follows. The same portions as those described in reference to FIGS. 1 to 9 are designated by the same reference numerals and their description will be eliminated. A printer 28 in the preferred embodiment of the present invention is made such that the electrical energizing print heads 2 provided with separate electrodes 6 are oppositely arranged at both surfaces. Due to this fact, a pair of electrical energizing print heads 2 oppositely facing to each other has no power of feeding the recording medium 5, so that a pair of feed rollers 29 are separately arranged. Then, as the recording medium 5, not only a recording medium provided with a conductive thermo-sensitive coloring layer 14, but also a recording medium 23 provided with a conductive thermo-sensitive transfer ink layer 25 can be used as shown in FIG. 10.

Figure 16:
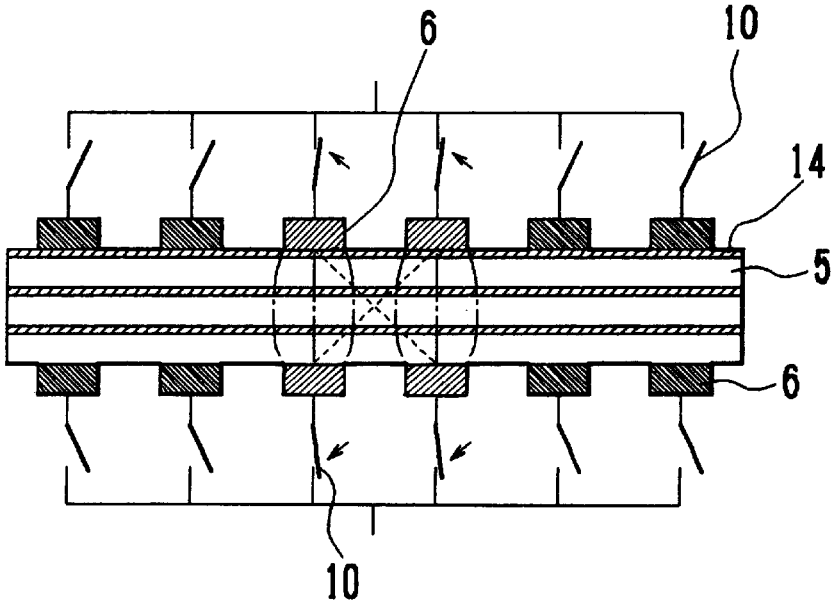
FIG. 16 is a side elevational view in longitudinal section for showing a problem in which a voltage is applied concurrently to adjoining separate electrodes.
Figure 17:
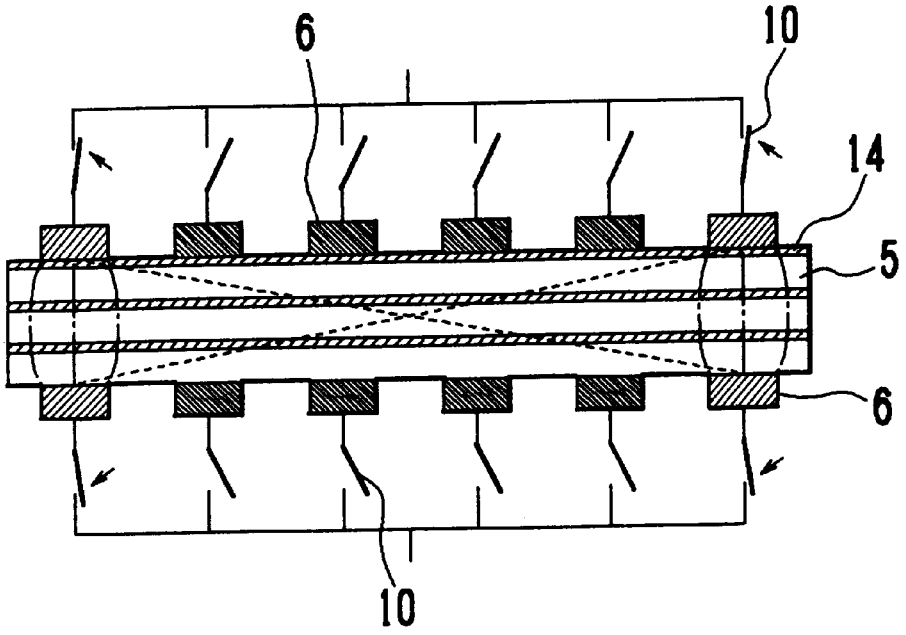
FIG. 17 is a side elevational view in longitudinal section for showing a normal electrical energized state in which a voltage is applied concurrently to spaced-apart separate electrodes.

With such an arrangement as above, when two electrical energizing print heads 2 are press contacted by a spring pressure and the recording medium 5 passes through the opposing segments, they are selectively energized by the separate electrodes 6 in response to a control signal so as to form the characters or figures. In this case, a group 10 of switch elements connected to the separate electrodes 6 placed at opposing positions of the separate electrodes 6 is controlled in such a way that they may not be closed concurrently in respect to at least the separate electrodes 6 placed at adjoining positions. That is, as shown in FIG. 16, when a voltage is applied concurrently to the adjoining separate electrodes 6, currents flowing in the recording medium 5 are mixed to each other, so that an adverse effect is applied to an accurate fine degree or the like. Due to this fact, the application of voltage as shown in FIG. 16 is not carried out, but as shown in FIG. 17, voltage is applied to a pair of spaced-apart separate electrodes 6 so as to prevent interference from being generated when dots are formed. Then, in the case that it is necessary to form dots at adjoining segments, an electrical energization is carried out in a different timing.

In each of the aforesaid preferred embodiments, the overlapped number of recording media 5, 23 is not limited to three, but a further large number of recording media can be overlapped.

Figure 18:
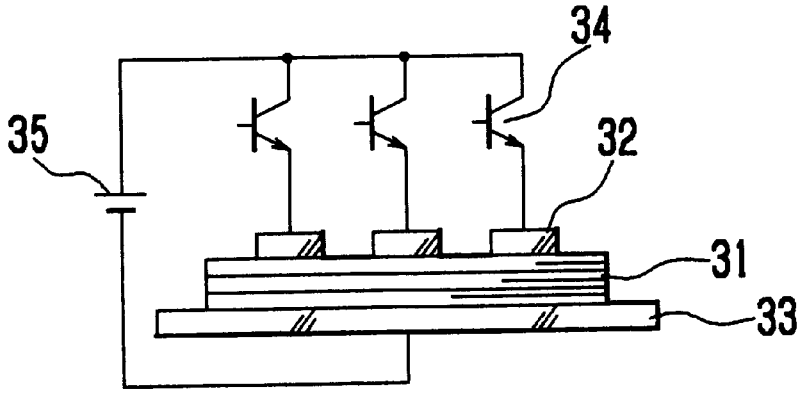
FIG. 18 shows a fourth preferred embodiment of the present invention in which a fundamental configuration of a non-impact recording method is illustrated.

Referring to FIGS. 18 to 32, a fourth preferred embodiment of the present invention will be described. At first, the system shown in FIG. 18 is a basic configuration view for showing a non-impact recording method of the preferred embodiment of the present invention. At first, a plurality of separate electrodes 32 are contacted with one side of a plurality of overlapped conductive recording media 31 and a common electrode 33 is oppositely contacted with the other side of the recording media 31. Each of the separate electrodes 32 is connected to one electrode of a power supply 35 through a controlling switch 34, and the common electrode 33 is directly connected to the other electrode of the power supply 35, respectively. The controlling switch 34 selectively turns ON-OFF a connection between the separate electrode 32 and one electrode of the power supply 35 in response to a control signal. When an electrical energization is carried out between the separate electrode 32 and the common electrode 33 selected by the controlling switch 34, characters or images are recorded concurrently on each of the overlapped conductive recording media 31 with Juhle heat generated at the conductive recording medium 31.

The system shown in FIG. 19 relates to a flow of the energization current in the conductive recording medium 31 in the recording method of the preferred embodiment of the present invention. FIG. 19 is an illustrative view in which when point electrodes corresponding to the separate electrodes 32 are contacted with and arranged at one side of the two stacked resistor layers 31*a*, 31*b* corresponding to the overlapped conductive recording media 31, and a surface electrode corresponding to the common electrode 33 is contacted with and arranged at the other side of the resistor layers and they are electrically energized, a relation between a relative value of volume resistivities of the two resistor layers 31*a*, 31*b* and an electrical current flowing in the layers is schematically indicated in response to a result of computer simulation. In this figure, although a current density is indicated schematically in a stepwise image concentration, its practical density shows a continuous distribution. In FIG. 9, ρ represents volume resistivities.

Figure 19A:
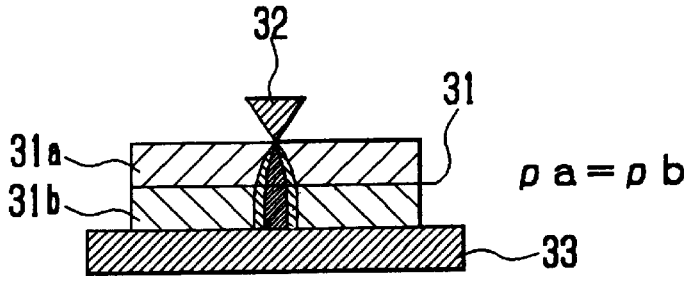
FIG. 19 is an illustration for schematically showing a flow of energizing current in a recording medium, wherein (A) is a case in which volume resistivities of the stacked conductive recording media are approximately the same to each other, (B) is another case in which volume resistivity at the common electrode side is low and (C) is a still further case in which volume resistivity at the common electrode is high, respectively.
Figure 19B:
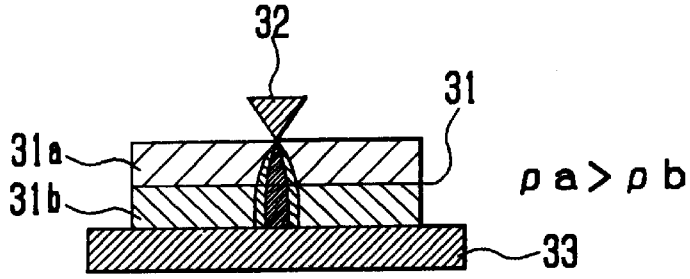
Figure 19C:
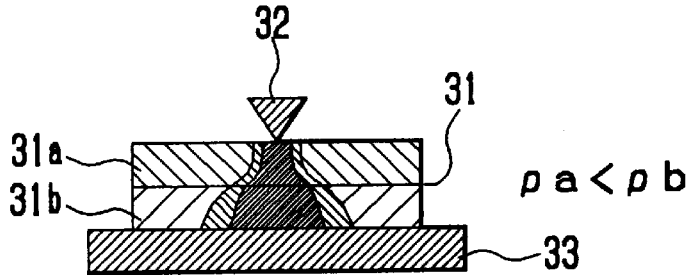

In view of the foregoing, FIG. 19(A) shows a flow of energizing current in a case in which volume resistivities of the two resistor layers 31*a*, 31*b* are the same to each other, FIG. 19(B) shows a flow of energizing current in a case in which volume resistivity of the resistor layer 31*a* at the point electrode is higher than volume resistivity of the resistor layer 31*b* at the surface electrode, and FIG. 19(C) shows a flow of energizing current in a case in which volume resistivity of the resistor layer 31*a* at the point electrode is lower than volume resistivity of the resistor layer 31*b* at the surface electrode, respectively.

In the recording method of the preferred embodiment of the present invention, although it is necessary that an energizing current flowing in a plurality of overlapped conductive recording media 31 is concentrated near a straight line connecting each of the separate electrodes 32 with the common electrode 33 in the shortest distance, as apparent from the illustrated state, the states shown in FIGS. 19(A) and 19(B) are suitable and the state shown in FIG. 19(C) is not suitable. That is, in the recording method of the preferred embodiment of the present invention, it is inconvenient that there is provided a relation of relative values of volume resistivities corresponding to that shown in FIG. 19(C) in a plurality of overlapped conductive recording media 31 which are present between the separate electrode 32 and the common electrode 33. More practically, if such a relation as described above is present between the conductive recording medium 31 of single layer and another conductive recording medium 31, between each of the layers of conductive recording medium 31 composed of a plurality of layers and between its constituting layer and a constituting layer of another conductive recording medium 31 or between the common electrode 33 and the constituting layers of the conductive recording medium 31, the flowing current is not concentrated near a straight line connecting each of the separate electrodes 32 with the common electrode 33 in the shortest distance and so a plurality of clear recording images can not be attained concurrently. Accordingly, although it is dependent on a thickness of the conductive recording medium 31 or an accurate fine degree of image to be targeted, it is necessary that a relative value of volume resistivities may keep a relation indicated in FIG. 19(A) or 19(B) in an electrical current passage between the separate electrode 32 and the common electrode 33. However, the state shown in FIG. 19(B) shows a disturbance in volume resistivity of the conductive recording medium 31 during its manufacturing process or a troublesome operation in which a plurality of conductive recording media 31 must be combined in an order of values of volume resistivities and more practically, it is desirable that volume resistivities of each of the layers constituting one conductive recording medium 31 shown in FIG. 19(A) or between each of the conductive recording media are approximately the same from each other and the volume resistivity of the common electrode 33 is set to be lower by more than 1 digit than volume resistivity in the layer of the conductive recording medium 31 contacted with the common electrode.

Figure 20:
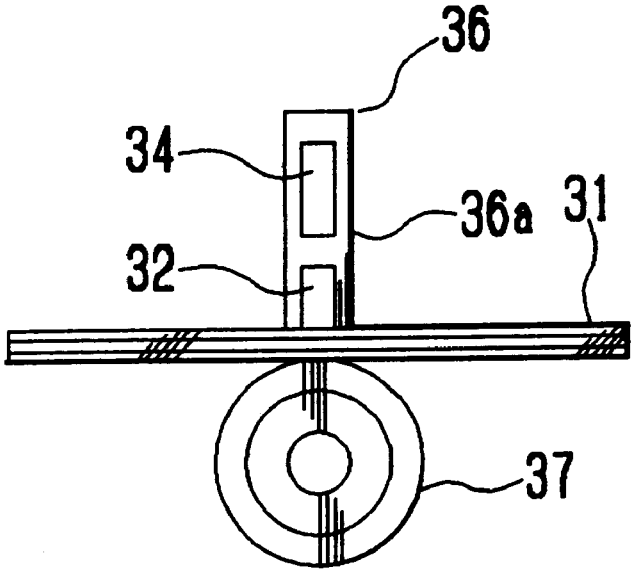
FIG. 20 is a fundamental configuration of a recording device.

Then, referring to FIG. 20, an absolute value of volume resistivity required in the conductive recording medium 31 in the recording method of the preferred embodiment of the present invention will be described as follows. As shown in FIG. 20, a practical recording device is constructed such that many separate electrodes 32, a control switch 34 for turning ON-OFF individually an electrical energization for the separate electrodes and a recording head 36 having a semiconductor IC chip integrated with a control circuit therefor stored in one enclosure are contacted with and arranged at one side of a plurality of overlapped conductive recording media 31 and a platen 37 having a function to hold or transport the conductive recording medium 31 as well as another function of the common electrode 33 is oppositely contacted with and arranged against the other side of them.

Thus, in the recording device in which the thermo-sensitive coloring layer generates color with heat generated in the conductive recording medium 31 through its electrical energization or the thermo-sensitive fusing ink layer is transferred, too much higher absolute value of volume resistivity of the conductive recording medium 31 requires a higher voltage for supplying an electrical power required for printing, although in reference to an insulating distance between the group of separate electrodes 32 of the recording head 36 or between a semiconductor IC and the enclosure or a yield voltage of the semiconductor IC by itself, an insulating distance between the common electrode 33 of the platen 37 and another mechanism member, or safety of user in operation or the like, a voltage which can be applied to the conductive recording medium 31 is less than several hundred V at the most, and in particular, in portable type equipment requiring a demand for a plurality of concurrent recording functions, it is preferable to keep it within several ten Vs in view of a battery cell power supply.

In addition, too much lower volume resistivity of the conductive recording medium 31 may generate some problems that it causes the thermo-sensitive coloring layer to generate color or current for supplying an electrical power required for transferring the thermo-sensitive fusing ink layer to be increased and so it is not suitable for a driving of the semiconductor IC. As major causes related to this voltage, there are items of a thickness and the number of overlapped sheets, volume inherent resistivity, a recording sensitivity and an image recording speed of the conductive recording media 31. As an example, it is assumed to perform an electrical energization and recording against the bill having three overlapped conductive recording media 31 of conductive thermo-sensitive color generating paper having a thickness of 50 $\mu$m with a power supply voltage of 12V, a dot size of 125 $\mu$m in its longitudinal size and lateral size and a speed of 5 ms per 1 dot. It is assumed that this conductive thermo-sensitive color generating sheet has a color generating sensitivity reaching a proper concentration with a standard dot size of 125 $\mu$m in its longitudinal size and lateral size in a technical level of the present time and also with an applied electrical power of 0.1 W per one dot and for 5 ms. If it is assumed that no reduction in voltage of power supply of a battery cell or no voltage drop in a midway passage in a control circuit is present, and volume resistivities of the separate electrode 32 and the common electrode 33 show such a low value as one to be ignorable as compared with that of the conductive recording medium 31 and the electrical energizing current is not dispersed from the extremity end of the separate electrode 32 with a longitudinal size and a lateral size of 125 $\mu$m toward the common electrode 33, but forwards straight in the conductive recording medium 31, the voltage per one sheet of the three overlapped bill is 4V, resulting in that a resistance value in a thickness direction required at a part corresponding to one dot is about 160 Ω in order to supply an electrical power of 0.1 W per one dot in each of the sheets and calculation of volume resistivity of the conductive recording medium 31 becomes 5 Ω·cm. In addition, an electrical current flowing at this time is 25 mA per one dot and this is a range which is suitable for driving of the semiconductor IC.

In general, if it is assumed that a thickness of the conductive recording medium 31 is (t), the number of overlapped sheets is (n), volume resistivity is ρ, a recording sensitivity (an electrical power×time per unit area required to reach a predetermined recording concentration) is (s) and a required recording speed is (v), there occurs a relation of $$E^2 n \cdot t \cdot \rho \cdot s \cdot v$$

in respect to the applied voltage E, resulting in that if it is assumed that the voltage E which can be applied to the conductive recording medium 31 is in a range of two digits from several Vs to several hundred Vs, a product of n, t, ρ, s and v may become a range of four digits.

In the aforesaid example of calculation, since the sensitivity (s) of the conductive recording medium 31 is a standard value, this value is treated as a fixed value and a range of volume resistivity (ρ) of the conductive recording medium 31 used in the recording device which can be realized is calculated to attain as follows.

An upper limit value of volume resistivity (ρ) is determined in reference to a maximum value of applicable voltage E, a thickness (t) of the conductive recording medium 31, an overlapped number of sheets (n) and a minimum value of a recording speed (v). When volume resistivity ρ is calculated under an assumption that an applied voltage E is 120v of ten times, a thickness (t) of the recording medium is 25 μm of a half value, an overlapped number (n) is two in view of its original object and a recording speed (v) is 2.5 mm/sec of 1/10 in respect to the conditions of the example of calculation described above, it becomes $1.5\times10^4$ Ω·cm. However, in the case that a practical recording device is assumed to be applied, as for the applied voltage E, it is necessary to consider a turning ON-OFF current value of LSI for controlling an energized electrical current or a chip size and its accompanying device price in reference to the aforesaid conditions of calculation and upon consideration of the power supply of a battery cell for portable type information equipment showing much amount of demands for this copying function, it is desirable to set it within 36 V of three times. In addition, the thickness (t) of the recording medium of 25 μm of a half value is assumed to be a value which is approximately near a practical lower limit value in reference to a strength or an easy handling of it and the recording speed (v) is assumed to have a minimum value of 12.5 mm/sec of a half value. Calculation of the volume resistivity (ρ) of the recording medium under the aforesaid conditions shows a value of $2.7\times10^2$ Ω·cm or less. A lower limit value of the volume resistivity (ρ) is determined by the minimum value of the operating voltage E of LSI for controlling an energization current, the maximum value of the current capable of turning-ON or OFF, a thickness (t) of the recording medium, the maximum value of the overlapped number (n) of sheets and the minimum value of a size (area) (a) of a dot. The minimum value of the voltage E required for an operation of this LSI is 3 V which is near the lower limit value of Si semiconductor commercially available in the market and it is reasonable that as a maximum value of current capable of turning-ON or OFF, the maximum value of 100 mA, which is dependent upon a degree of integration or a chip size, is applied. Accordingly, a load resistance value R which this LSI can control becomes 30 Ω or more.

There remains a relation of $$\rho=R\cdot a/n\cdot t$$

in this load resistance R, a thickness t of the recording medium, an overlapped number (n) of sheets, volume resistivity (ρ) and a size (area) (a) of a dot to be recorded.

Also in this case, if it is assumed that some practical conditions required for this overlapped copying and recording are set, the thickness (t) of the conductive recording medium 31 of 100 μm of twice is near its upper limit value in consideration of its easy handling or price, and there occurs scarcely a demand to have the overlapped number (n) of sheets more than 9 sheets of three times and a value of three to seven sheets is usually applied. In addition, longitudinal and lateral sizes of 62.5 μm in which a size (a) of dot is ¼ (a degree of fine accuracy is twice) is a sufficient degree of fine accuracy in a field where this overlapped copying and recording is used. Upon calculation of volume resistivity (ρ) under these conditions, it becomes $2.0\times10^{-2}$ Ω·cm or more.

FIG. 21 is an illustrative view for showing various kinds of conductive recording media 31 applied in the non-impact recording method of the preferred embodiment of the present invention.

Figure 21A:
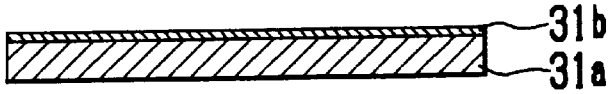
FIG. 21 illustrates various kinds of conductive recording media, wherein (A) is a case in which a thermo-sensitive coloring layer is formed at the front surface of a substrate being applied a conductive characteristic, (B) is a case in which there is provided a single layer being applied a conductive characteristic and a thermo-sensitive color generating characteristic, (C) is a case in which a thermo-sensitive coloring layer is formed at the front surface of the substrate being applied a conductive characteristic and a thermo-sensitive fusing ink layer is formed at the rear surface of it, (D) is a case in which a thermo-sensitive fusing ink layer is formed at the rear surface of the substrate being applied a conductive characteristic and a thermo-sensitive color generating characteristic, (E) is a case in which a thermo-sensitive fusing ink layer is formed at the rear surface of the substrate being applied a conductive characteristic, and (F) is a case in which there is provided a single layer of substrate being applied a conductive characteristic.

At first, FIG. 21(A) shows a conductive recording medium 31 having double-layer structure in which thermo-sensitive liquid coloring agent having white or light-colored conductive fine particles mixed and dispersed therein is coated on and dried on the surface of the substrate 31*a* having an electrical conduction by immersing and drying water-soluble high molecular liquid having conductive fine particles in a normal paper not containing filler agent or binder so as to form the thermo-sensitive coloring layer 31*b*, wherein since two layers have an electrical conduction, an electrical energization can be carried out from the front surface to the rear surface and the thermo-sensitive coloring layer of the part corresponding to its passage may generate color with self-heat generated by an energized current to enable a recording image to be attained.

Figure 21B:
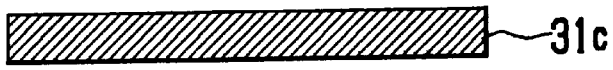

FIG. 21(B) shows a conductive thermo-sensitive recording medium 31 (31*c*) having a single layer structure in which a normal paper not containing filler agent or binder and dried is immersed with thermo-sensitive liquid coloring agent having white or light-colored conductive fine particles mixed and dispersed therein, wherein it has uniform electrical conduction and thermo-sensitive color generating characteristic from the front surface to the rear surface, the part corresponding to its passage may generate color with self-heat generated by an energized current to enable a recording image to be attained.

Figure 21C:
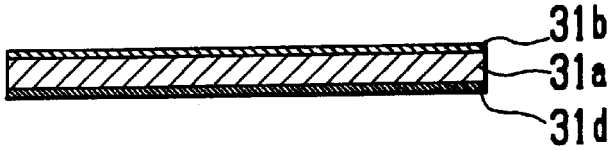

FIG. 21(C) shows a conductive recording medium 31 having three-layer configuration in which thermo-sensitive fusing ink layer 31*d* is formed by coating thermo-sensitive transfer ink having conductive fine particles mixed and dispersed therein on the back surface of the conductive recording medium 31 shown in FIG. 21(A) and drying it, wherein since all three layers have an electrical conduction, it is possible to apply an electrical energization from the front surface to the rear surface, a thermo-sensitive coloring layer of the part corresponding to its passage may generate heat with self-generating heat by the electrical energized current and the thermo-sensitive transfer layer is transferred to another conductive recording medium to enable a recording image to be attained.

Figure 21D:
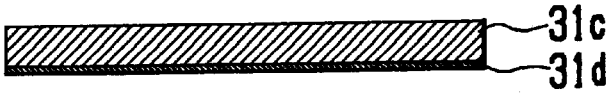

FIG. 21(D) shows a conductive recording medium 31 having double-layer structure in which thermo-sensitive fusing ink layer 31*d* is formed by coating thermo-sensitive transfer ink having conductive fine particles mixed and dispersed to the rear surface of the conductive recording medium 31 shown in FIG. 20(B) and drying it, wherein since two layers have an electrical conduction, an electrical energization can be carried out from the front surface to the rear surface and the thermo-sensitive coloring layer of the part corresponding to its passage may generate color with self-heat generated by an energized current to cause the thermo-sensitive transfer layer to be transferred to another conductive recording medium and to enable a recording image to be attained.

Figure 21E:
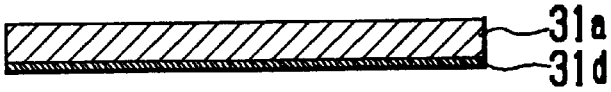

FIG. 21(E) shows a conductive thermo-sensitive recording medium having double-layer structure in which thermo-sensitive fusing ink layer 31*d* is formed by coating thermo-sensitive fusing ink having conductive fine particles mixed and dispersed to the rear surface of the substrate 31*a* applied with an electrical conduction in advance, wherein since two layers have an electrical conduction, an electrical energization can be carried out from the front surface to the rear surface and when it is overlapped on the conductive recording medium 31 shown in FIGS. 21(C) and 21(D) and electrically energized, the thermo-sensitive fusing ink layer of the conductive recording medium 31 can be transferred to another conductive recording medium 31 and then a recording image can be attained.

Figure 21F:
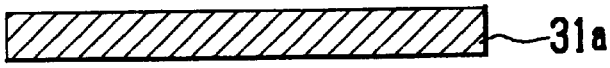

FIG. 21(F) shows a conductive recording medium 31 of single layer having a substrate 31*a* having an electrical conduction, wherein when it is overlapped on the conductive recording medium 31 shown in FIGS. 21(C), 21(D) and 21(E) and electrically energized, the thermo-sensitive fusing ink at the part corresponding to its flow passage is transferred to the conductive recording medium 31 and then a recording medium can be attained.

Figure 22:
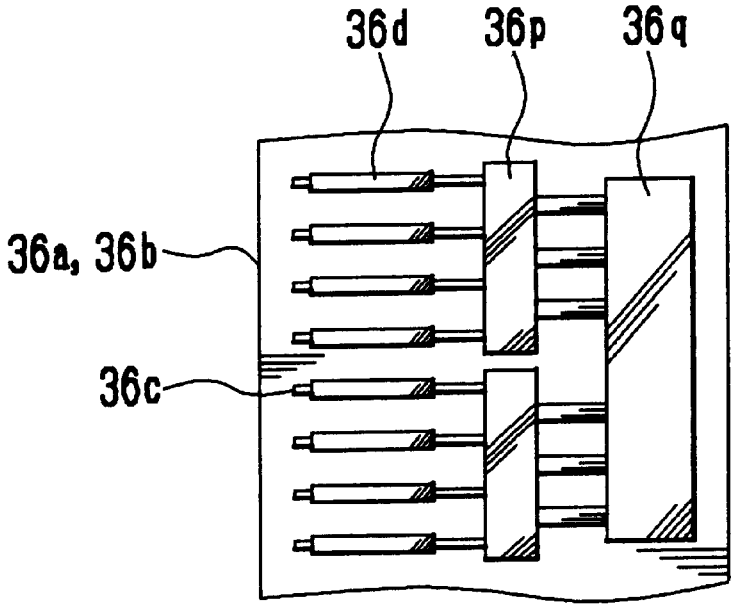
FIG. 22 is a top plan view for showing a recording head.

FIGS. 22 and 23 are illustrative views for showing an electrical energization recording head used in the recording device of the preferred embodiment of the present invention, wherein it is moved while it is being contacted with the front surface of the conductive recording medium 31 held at the platen 37 or it is contacted with the conductive recording medium 31 held and transported at the platen 37 while it is kept still so as to attain a recording image.

FIG. 22 is a top plan view for showing the recording head 36, wherein conductive layers 36*c* stacked on either the surface of the supporting member 36*a* or the surface of an electrical and thermal insulating layer 36*b* formed on the former surface are formed into patterns to make an electrical wiring circuit with a group of many separate electrodes 32, a group of control switches 34 for individually turning-ON or OFF an electrical energization for the group of separate electrodes 32 and semiconductor IC chips 36*p* having a control circuit integrated therein or a connector 36*q* connected to an external unit.

FIG. 23 is an illustrative view for showing the sectional structure in a thickness direction of a supporting member for the recording head 36, an insulating layer stacked on the surface of the supporting member and the conductive layer.

FIG. 23 (A) shows a case in which the supporting member 36*a* for the recording head 36 is made of metal having a high electrical conduction and a high thermal conduction, wherein the conductive layer 36*c* stacked on electrical and thermal insulating layer 36*b* made of synthetic resin formed on the surface of the supporting member is formed into a pattern to make a group of separate electrodes 32. Since there is a low thermal conduction between it and the metallic supporting member by the insulating layer 36*b*, a thickness of the conductive layer 36*c* is made thin, a heat capacity of the separate electrode 32 becomes low and further since a heat resistance in a direction of surface is increased, heat generated in the conductive recording medium 31 is restricted from flowing out toward the composing member of the recording head 36 through the separate electrode 32 and further it is possible to prevent a recording concentration of the conductive recording medium 31 contacted with the recording head 36 from being reduced.

Figure 23A:
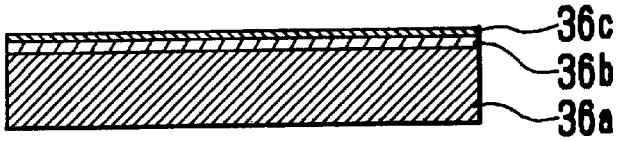
FIG. 23 is an illustrative view for showing a recording head, wherein (A) is a case in which a conductive layer is formed at the surface of a supporting member through an insulating layer, (B) is a case in which a conductive layer is formed at the surface of the supporting member, (C) is a case in which a conductive film is formed at the surface of an insulating layer of a synthetic resin film and fixed to the supporting member, (D) is a case in which a conductive film is formed at the surface of an insulating layer of a synthetic resin film and fixed to the supporting member through a member having a rubber resilient characteristic, and (E) is a case in which an anti-wearing conductive film is formed at a part contacting with the conductive recording medium.
Figure 23B:
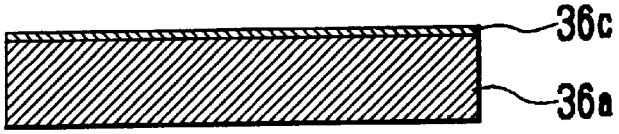

FIG. 23(B) shows a case in which the supporting member 36*a* of the recording head 36 is made of synthetic resin having a high electrical insulating characteristic and a high thermal resistance or glass, wherein the conductive layer 36*c* directly formed at its surface is formed into a pattern shape so as to make a group of separate electrodes 32. Since the supporting member 36*a* has a low thermal conduction characteristic, a thin conduction layer 36*c* causes a heat capacity of the separate electrode 32 by itself to be decreased and further causes a heat resistance in a direction of surface to be increased, heat generated in the conductive recording medium. 31 is prevented from being flowed out to the composing members of the recording head 36 through the separate electrodes 32 and thus it is possible to prevent a recording concentration of the conductive recording medium 31 contacted with the recording head 36 from being reduced.

Figure 23C:
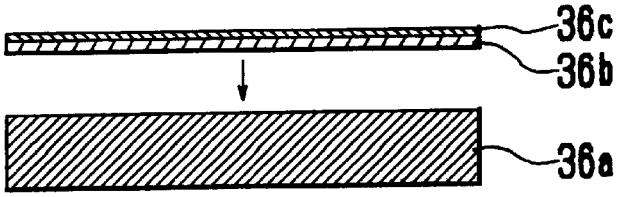

FIG. 23(C) shows a case in which a group of separate electrodes 32 of the recording head 36 is formed by making a pattern of conductive films 36*c* stacked on the surface of the insulating layer 36*b* of synthetic resin film having an electrical insulating characteristic and a thermal insulating characteristic, wherein since there is a low thermal conduction between it and the supporting member 36*a* by the synthetic resin film, a thin formation of the conductive layer 36*c* causes a heat capacity of the separate electrode 32 by itself to be reduced and in turn a thermal resistance in a direction of surface is increased, so that heat generated in the conductive recording medium 31 is restricted from flowing out toward the composing members of the recording head 36 through the separate electrodes 32 and it is possible to prevent a recording concentration of the conductive recording medium 31 contacted with the recording head 36 from being decreased.

Figure 23D:
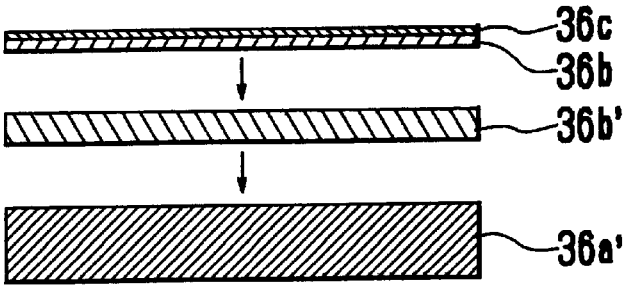

FIG. 23(D) shows an arrangement in which a member 36*b*' having a rubber resilience is arranged between the aforesaid insulating layer 36*b* of synthetic resin film having a group of separate electrodes 32 of the recording head 36 formed therein and the supporting member 36*a* for fixing the insulating layer, wherein a thin formation of the conductive layer 36*c* causes a heat capacity of the separate electrode 32 by itself to be decreased, and in addition a heat resistance in a direction of surface to be increased, so that heat generated in the conductive recording medium 31 is restricted from being flowed out toward the composing members of the recording head 36 through the separate electrodes 32 and a recording concentration of the conductive recording medium 31 contacted with the recording head 36 is prevented from being decreased and it is possible to make a positive contact between the conductive recording medium 31 and the group of separate electrodes 32 through the rubber resilient member 36*b*'.

Figure 23E:
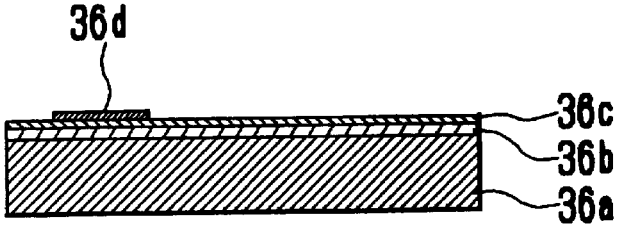

FIG. 23(E) shows an arrangement in which an anti-wearing conductive film 36*d* is stacked at a part contacted with the conductive recording medium 31 of the conductive layer 36*c* forming a group of separate electrodes 32 of the recording head 36 which are electrically independent to each other, and thus it is possible to restrict a wearing of the group of separate electrodes 32 caused by a contacted sliding motion of the conductive recording medium 31.

FIGS. 24 and 25 are illustrative views for showing a platen 37 used in a practical recording device based in reference to the preferred embodiment of the present invention, wherein it has a function of the common electrode 33 in addition to a holding function or transporting function of the conductive recording medium 31.

Figure 24A:
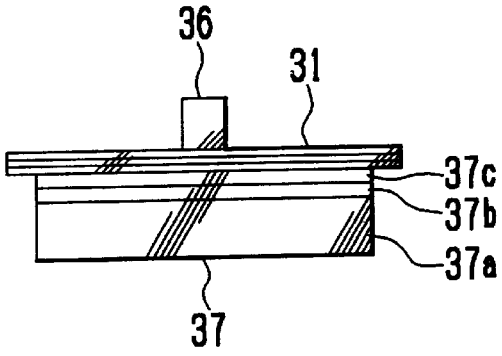
FIG. 24 illustrates one example of a practical recording device, wherein (A) is an example of flat type platen and (B) is an example of cylindrical type platen.
Figure 24B:
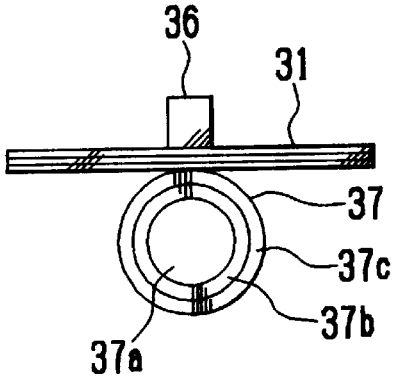

FIG. 24(A) shows a flat plate type platen 37 and FIG. 24(B) shows a column-like platen 37, therein the platen has a function to hold and transport the conductive recording medium 31 and a function of the common electrode 33.

FIGS. 24(A) and (B) show an arrangement in which 37*a* denotes a mechanism member of a platen, 37*b* denotes an electrical and thermal insulating layer and 37*c* denotes a conductive layer acting as a common electrode, respectively.

FIG. 25 is an illustrative view for showing a sectional structure of the platen 37. FIG. 25(A) shows a case in which an entire mechanism member 37*a* of the platen 37 is of a conductive member, wherein if its volume resistivity is equal to or less than volume resistivity of the conductive recording medium 31 contacted with it, as described above, an electrical energizing current flows in a concentric manner at a part of the shortest distance between the separate electrode 32 and the common electrode 33 of the conductive recording medium 31. In addition, in the case that a heat conductivity of the mechanism member 37*a* of the platen 37 is 1 $W \cdot m^{-1} \cdot K^{-1}$ or less, heat generated in the conductive recording medium 31 can be prevented from flowing out toward the common electrode 33 and it is possible to prevent a recording concentration of the conductive recording medium 31 contacted with it from being decreased.

Figure 25A:
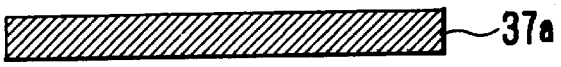
FIG. 25 is an perspective view for showing a platen, wherein (A) is a case in which there is provided a single layer of which entire part is a conductive member, (B) is a case in which a conductive layer is formed at a mechanism member, (C) is a case in which a conductive layer of conductive rubber is formed at a mechanism member, (D) is a case in which a conductive layer is formed at the surface of a mechanism member through a thermal insulating layer, and (E) is a case in which a conductive layer is formed at the surface of a mechanism member through a thermal insulating layer made of material having rubber resilience.
Figure 25B:
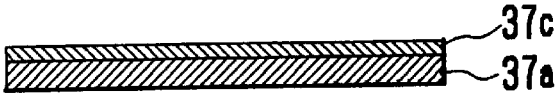

FIG. 25(B) shows an arrangement in which volume resistivity of the conductive layer 37*c* supported by the mechanism member 37*a* of the platen 37 is lower than volume resistivity of the conductive recording medium 31 contacted with it and the conductive layer 37*c* is formed by a conductive layer having a heat conductivity of 1 $W \cdot m^{-1} \cdot K^{-1}$ or less, heat generated in the conductive recording medium, an electrical current flowing in a direction of thickness of the conductive recording medium 31 is prevented from being dispersed in the conductive recording medium 31 contacted with the common electrode 33 and at the same time heat generated in the conductive recording medium 31 can be restricted from flowing out toward the common electrode 33 and it is possible to restrict reduction of recording concentration of the conductive recording medium 31 contacted with the common electrode 33.

Figure 25C:
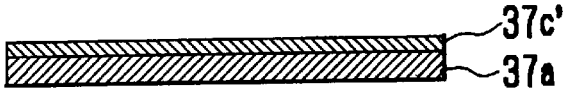

FIG. 25(C) shows a case in which a conductive layer 37*c* of FIG. 25(B) supported by a mechanism member 37*a* of the platen 37 is formed by a conductive rubber 37*c*', wherein an electrical current flowing in a direction of thickness of a plurality of stacked conductive recording media 31 is prevented from being dispersed in the conductive recording media 31 contacted with the common electrode 33, and due to a low heat conductivity of the conductive rubber layer, heat generated in the conductive recording media 31 can be restricted from being flowed out toward the common electrode 33, it is possible to prevent a recording concentration of the conductive recording media 31 from being reduced, it is possible to keep a superior electrical contact of the group of the separate electrodes 32 of the recording head 36, the common electrode 33 and the conductive recording media 31 and in the case that the common electrode 33 has a function to transport the conductive recording media 31, transportation of the conductive recording media 31 can be performed smoothly.

Figure 25D:
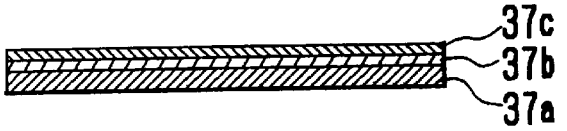

FIG. 25(D) shows an arrangement in which the surface of the mechanism member 37*a* of the platen 37 is formed with a conductive film having volume resistivity lower than volume resistivity of the conductive recording medium 31 contacted with it through a thermal insulating layer 37*b* with a heat conductivity being 1 $W \cdot m^{-1} \cdot K^{-1}$ or less, an electrical current flowing in a direction of thickness of a plurality of overlapped conductive recording media 31 is prevented from being dispersed in the conductive recording media 31 contacted with the common electrode 33, and due to a low heat conductivity of the conductive film, heat generated in the conductive recording media 31 can be restricted from being flowed out toward the common electrode 33 and further a recording concentration of the conductive recording media 31 contacted with the common electrode 33 can be prevented from being decreased.

Figure 25E:
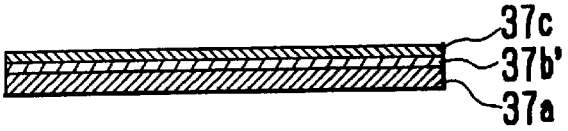

FIG. 25(E) shows an arrangement in which the thermal insulating layer 37*b* shown in FIG. 25(D) is formed by material 37*b*' having a rubber resilience, wherein an electrical current flowing in a direction of thickness of a plurality of overlapped conductive recording media 31 is prevented from being dispersed in the conductive recording media 31 contacted with the common electrode 33 or heat generated in the conductive recording media 31 is restricted from being flowed out toward the common electrode 33, a recording concentration of the conductive recording media 31 contacted with the common electrode 33 is prevented from being decreased, a superior electrical contact of the group of the separate electrodes 32, the common electrode 33 and the conductive recording media 31 of the recording head 36 is kept through its rubber resilience and at the same time in the case that the common electrode 33 has a function to transport the conductive recording media 31, the transportation of the conductive recording media 31 can be carried out smoothly.

Figure 26A:
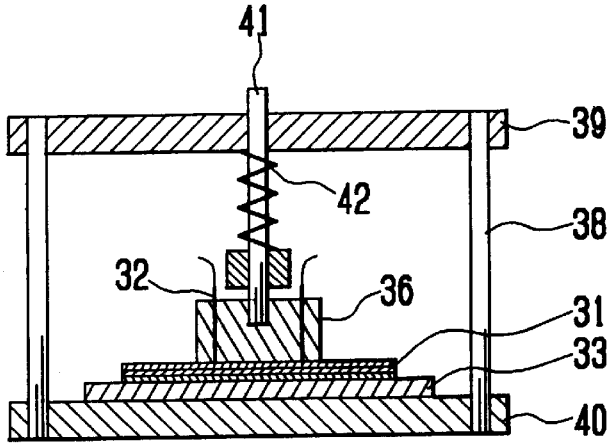
FIG. 26 is a structural view for showing a fundamental experimental device concerning a conductive recording medium, wherein (A) is a side elevational view and (B) is a circuit diagram.
Figure 26B:
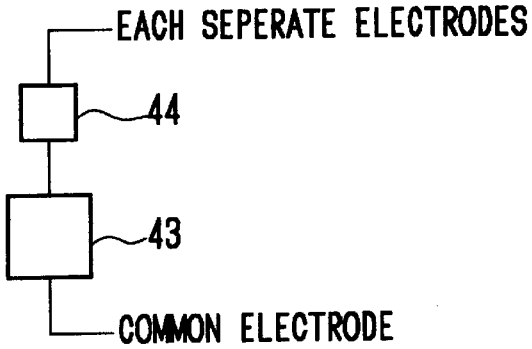

Then, various kinds of fundamental experiments performed in regard to the non-impact recording method of each of the preferred embodiments of the present invention will be described. FIG. 26 is an illustrative view for showing the fundamental experimental device operated in regard to the preferred embodiments of the present invention. As shown in the figure, there are provided two ABS upper and lower plates of a top plate 39 and a base plate 40 connected by coupler members 38, wherein the recording head 36 contacted with the upper surface of the conductive recording media 31 is biased toward the common electrode 33 (the platen 37) by a head pressing shaft 41, the top plate 39 having a through-pass hole through which the head pressing shaft 41 is slidably moved in a longitudinal direction and a coil spring 42. The platen 37 contacted with the lower surface of the conductive recording media 31 is used while it is being placed on the base plate of ABS resin.

A contact pressure between the recording head 36 and the platen 37 is adjusted by a pressure adjusting mechanism for the coil spring 42 of the head pressing shaft 41. In addition, a voltage applied to the conductive recording media 31 and an application time are set by a power supply 43 and a control switch 44.

Figure 27A:
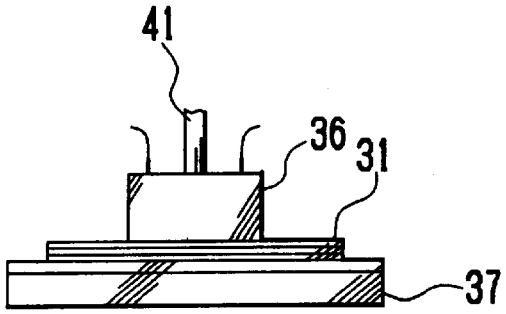
FIG. 27 is a structural view for showing a fundamental experimental device concerning a recording head, wherein (A) is an entire side elevational view, (B) is a sectional view for showing the recording head and (C) is a top plan view of the recording head.
Figure 27B:
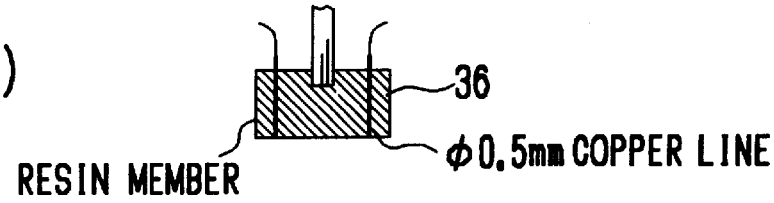
Figure 27C:
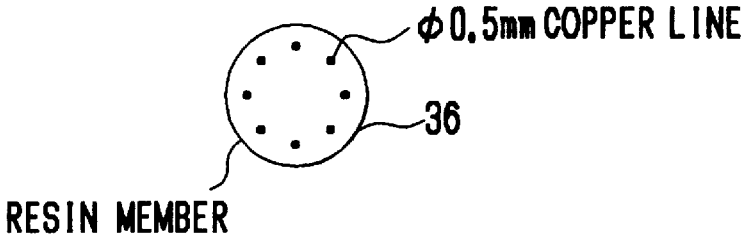

FIG. 27 is an illustrative view for showing a fundamental experiment concerning the conductive recording media 31 in which the experimental device shown in FIG. 26 is used. As shown in the figure, the recording head 36 is made such that a column-like ABS resin member having a diameter of 12 mm and a height of 10 mm is provided with a hole fitted to the head pressing shaft 41 at its center and eight copper wires of $\phi$0.5 mm are buried around the hole, the resin member is fixed to the head pressing shaft 41. As the platen 37, a member in which a conductive rubber layer having a thickness of 90 $\mu$m and volume resistivity of 4.5 $\Omega \cdot$cm is formed at the surface of an aluminum plate having a size of 100 mm×100 mm and a thickness of 1 mm was used. A contact pressure between the recording head 36 and the platen 37 was adjusted to show about 1.2 Kg under a state in which the conductive recording media 31 are removed.

The conductive recording media 31 used in this experiment is as follows.

The conductive recording medium (A):

Adding amount of conductive fine powder was increased or decreased to make one having the same volume resistivity or one having different volume resistivity by a conductive thermo-sensitive color generating sheet having a single-layered structure immersed with aqueous thermo-sensitive coloring agent liquid having white conductive fine powder dispersed therein and dried at a substrate sheet having a size of 60 mm×90 mm and a thickness of about 80 $\mu$m not containing filler agent or binder, and they were combined to each other to perform an electrical energization test.

Table 1(A) indicates a result of the test described above.

TABLE 1A

A. Recording Media with Single Structure

| Test No. | Recording Medium | | Volume Resistivity (Ω · cm) | Coloring State | Appld. Voltage (DC V) | Time (ms) |
|---|---|---|---|---|---|---|
| 1 | Double overlap | No. 1 | 2 to 4 × 10 | Approx. lean | 24 | 50 |
| | | No. 2 | " | Good | | |
| 2 | Double overlap | No. 1 | 2 to 4 × 10 | Approx. lean | 32 | 50 |
| | | No. 2 | 5 to 8 × 10 | Approx. lean | | |
| 3 | Double overlap | No. 1 | 5 to 8 × 10 | Approx. lean | " | " |
| | | No. 2 | 2 to 4 × 10 | Good | | |
| 4 | Double overlap | No. 1 | 2 to 4 × 10 | Approx. lean | 40 | 50 |
| | | No. 2 | 1.5 to 2.5 × $10^2$ | Slight color | | |
| 5 | Double overlap | No. 1 | 1.5 to 2.5 × $10^2$ | Approx. lean | " | " |
| | | No. 2 | 2 to 4 × 10 | Good | | |

The conductive recording medium (B):

Adding amount of conductive fine powder was increased or decreased to make two layers having the same volume resistivity or having different volume resistivity in a conductive thermo-sensitive color generating sheet of double layer structure in which a substrate sheet having a size of 60 mm×90 mm and a thickness of about 80 μm not containing filler agent or binder is coated with aqueous thermo-sensitive coloring agent liquid obtained by dispersing the same white conductive fine powder as that of the aforesaid recording medium (A) on the surface which is immersed in aqueous resin liquid having a white conductive fine powder dispersed therein, and dried, whereby they were combined to each other to perform an electrical energization test.

Table 1(B) indicates a result of the test described above.

TABLE 1B

B. Recording Media with Double Layer Structure

| Test No. | Recording Medium | | | Voltage Resistivity (Ω · cm) | Coloring State | Appld. Voltage (DC V) | Time (ms) |
|---|---|---|---|---|---|---|---|
| 6 | Single | No. 1 | Color Layer | 4 to 5 × 10 | Approx. lean | 24 | 50 |
| | | | Substrate Layer | 1.5 to 2 × 10 | — | | |
| 7 | Double overlap | No. 1 | Color Layer | 4 to 5 × 10 | Approx. lean | 32 | 50 |
| | | | Substrate Layer | 1.5 to 2 × 10 | — | | |
| | | No. 2 | Color Layer | 4 to 5 × 10 | Approx. lean | | |
| | | | Substrate Layer | 1.5 to 2 × 10 | — | | |
| 8 | Double overlap | No. 1 | Color Layer | 2 to 3 × $10^2$ | Approx. lean | 40 | 50 |
| | | | Substrate Layer | 1.5 to 2 × 10 | — | | |
| | | No. 2 | Color Layer | 2 to 3 × $10^2$ | No color | | |
| | | | Substrate Layer | 1.5 to 2 × 10 | — | | |

An observation attained in reference to Table 1(A) and Table 1(B) will be described as follows. Although its description overlaps with that described in reference to FIG. 19, irrespective of one layer and two layers of the overlapped conductive recording media 31, if all the volume resistivities of each of the layers constituting the conductive recording media 31 are the same to each other or they are relatively decreased in sequence from the separate electrode 32 toward the common electrode 33, it might not produce any problem, but if they are substantially different from each other, there remains a problem. In the result of experiment described above, as a degree of inversion of the relative values of the volume resistivities became 1 digit or more, a clear recording dot could not be attained. In addition, we found a phenomenon that a coloring in the first sheet contacted with the recording head 36 was lean as compared with that of the second sheet.

Figure 28A:
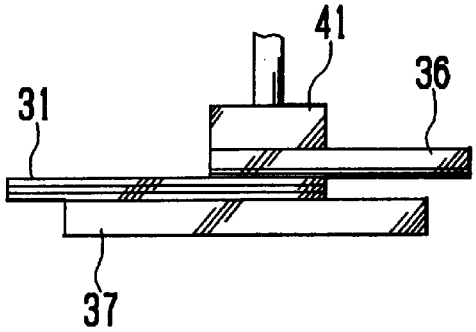
FIG. 28 is a structural view for showing a fundamental experimental device concerning an another type of recording head, wherein (A) is a side elevational view and (B) is a top plan view of the recording head.
Figure 28B:
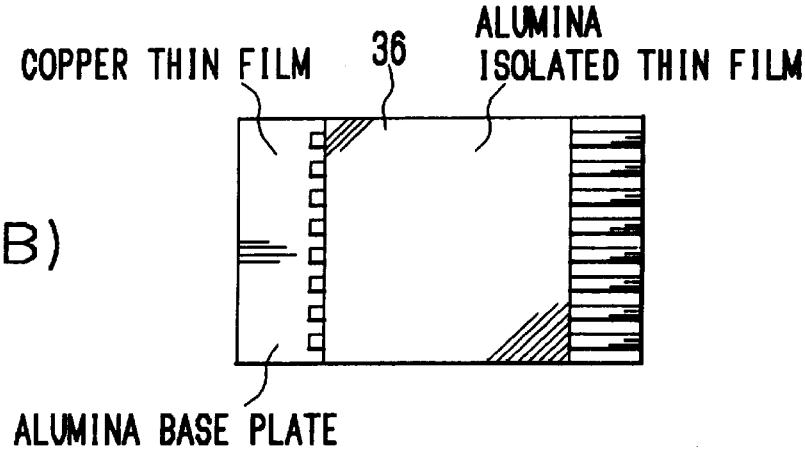

FIG. 28 is an illustrative view for showing a fundamental experiment concerning the recording head 36 using the experimental device shown in FIG. 26. In this experiment, as the conductive recording media 31, we applied overlapped three conductive thermo-sensitive coloring sheets in which aqueous thermo-sensitive coloring agent liquid having white conductive fine powder dispersed therein was immersed in a substrate sheet having a size of 60 mm×90 mm and a thickness of 80 μm not containing filler material or binder therein and dried to show volume resistivity of about 5 to 8×$10^2$ Ω·cm. As the platen 37, we used a member formed with a conductive rubber layer having a thickness of 90 μm and volume resistivity of 4.5 Ω·cm on the surface of an aluminum plate of a size of 100 mm×100 mm and a thickness of 1 mm which was used in the fundamental experiment of the aforesaid conductive recording media 31. A contact pressure between the recording head 36 and the platen 37 was adjusted to become about 1.2 Kg under a state in which the conductive recording media 31 were removed, and a voltage of DC 40V was applied for 50 ms.

The recording head 36 used in this experiment is as follows.

The recording head (A):

Eight copper wires of ϕ0.5 mm are buried into column-like ABS resin shown in FIG. 27 and the recording head used in the fundamental experiment concerning the conductive recording media 31 is applied as it is.

The recording head (B):

This is the recording head 36 having a shape similar to that of recording head (C) shown in FIG. 28, wherein a thin film of metallic aluminum with a thickness of 1 μm vapor deposited on a glass substrate having a size of 20 mm×50 mm and a thickness of 1 mm is etched to make a pattern of belt having a width of 0.5 mm and alumina is sputtered with a part of 0.5 mm from its extremity end and the terminal part being left to form an insulating film.

The recording head (C):

This is a recording head 36 having a shape shown in FIG. 28, wherein an insulating film of polyimide resin with a thickness of about 4 μm is formed at the surface of a metallic aluminum substrate, a thin copper film having a thickness of 1 μm is stacked on it by sputtering to make a pattern of belt with a width of 0.5 mm and alumina is sputtered with a part of 0.5 mm from its extremity end and the terminal part being left to form an insulating film.

The recording head (B) and the recording head (C) are not formed into a circle like that of the recording head (A).

However, as shown in FIG. 28, its position in respect to the conductive recording media 31 was displaced and contacted with it, and a contact pressure per unit area was adjusted by an adjusting mechanism for the coil spring 42 in such a way that it may become the same value as that of the recording head (A). Table 2 indicates a result of the test.

TABLE 2

| Test No. | Structure of Head | Coloring State of a Recording Medium Contacted with Head |
|---|---|---|
| 9 | Copperwires (ϕ 0.5 mm × 15 mm) are buried in an ABS resin column (ϕ 12 mm × 10 mm)(see FIG. 27). | Lean |
| 10 | A thin film of metallic aluminum (thickness of 1 μm) stacked on a glass substrate (20 mm × 50 mm × 1 mm) is formed into a pattern (see FIG. 28). | Good |
| 11 | A copper thin film (with a thickness of 1 μm) stacked on an insulating film (thickness of 4 μm) of polyimide resin is formed into a pattern on the surface of an aluminum substrate (20 mm × 50 mm × 1 mm) (see FIG. 28). | Good |

An observation attained in reference to Table 2 will be described. A reason why a coloring at the first conductive thermo-sensitive coloring sheet was lean against the second coloring sheet when the recording head (A) was used is estimated by the fact that a heat conductivity of copper that is the material of the separate electrode 32 in the recording head (A) is high of about 400 $W \cdot m^{-1} \cdot K^{-1}$ and a heat capacity of a copper wire with ϕ0.5 mm is high, so that heat generated in the first thermo-sensitive coloring sheet by energized current is absorbed in the separate electrode 32.

As a reason why a phenomenon found in the recording head (A) did not appear remarkably when the recording head (B) and the recording head (C) were used, it is estimated that the separate electrodes 32 in the recording head (B) and the recording head (C) are of thin film patterns stacked on a glass plate or a polyimide film having a low heat conduction, although a heat conductivity of metallic aluminum acting as that material is about 230 to 240 $W \cdot m^{-1} \cdot K^{-1}$ and a heat conductivity of copper is high as about 400 $W \cdot m^{-1} \cdot K^{-1}$ as described above, their thicknesses are of 1 μm to cause a heat capacity of the separate electrode 32 by itself to be low and since a heat resistance in a direction of film surface is high, heat generated in the conductive thermo-sensitive coloring sheet is prevented from being transmitted through the separate electrode 32 and its band-like pattern and flowed out toward the composing members of the recording head 36.

Figure 29A:
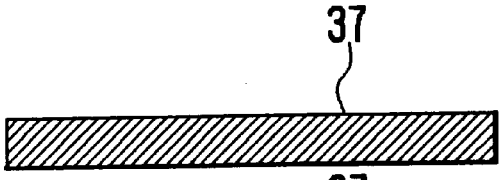
FIG. 29 illustrates a platen used in experiment, wherein (A) is a case in which there is provided a metallic single layer, (B) is a case in which a conductive member other than metal is laid or formed at the surface of metal and (C) is a case in which both a metallic foil and a metallic thin film are laid or formed at the surface of a glass plate.
Figure 29B:
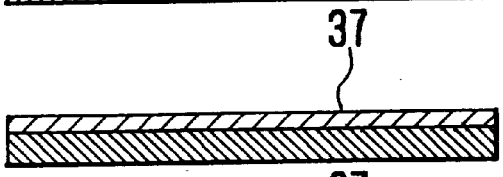
Figure 29C:
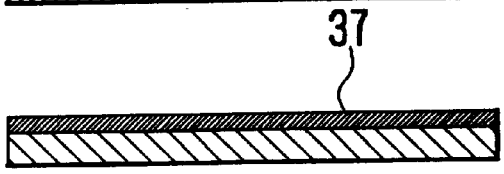

FIG. 29 is an illustrative view for showing a fundamental experiment concerning the platen 27 in which the experimental device shown in FIG. 26 is used. In this experiment, as the conductive recording media 31, we used three overlapped conductive thermo-sensitive coloring sheets with volume resistivity of about 5 to 8×10 Ω·cm in which aqueous thermo-sensitive coloring agent liquid having white conductive fine powder dispersed therein immersed in and dried at a substrate sheet having a size of 60 mm×90 mm and a thickness of about 80 μm not containing filler material or binder. The recording head 36 is made such that eight copper wires with ϕ0.5 mm are buried in a column-like ABS resin shown in FIG. 27, wherein the recording head 36 used in the fundamental experiment concerning the conductive recording media 31 by itself was used. A contact pressure between the recording head 36 and the platen 37 was adjusted in such a way that it may become about 1.2 kg under a state in which the conductive recording media 31 are removed and then a voltage of DC 40V was applied for 50 ms.

The platens used in this experiment are as follows.

Platen (A):

This is a platen 37 having a metallic single layer structure shown in FIG. 29(A), wherein an aluminum plate, an aluminum foil and a stainless steel plate (SUS304) were placed on a base plate 40 of ABS resin in the experimental device shown in FIG. 26, a power supply was directly connected to them and experiment was carried out.

Platen (B):

This is a platen 37 having a double-layer structure in which conductive material other than metal is arranged at the surface of the aluminum plate having a size of 100 mm×100 mm and a thickness of 1 mm as shown in FIG. 29(B). As conductive material, conductive rubber sheet, conductive paper sheet and conductive cloth were overlapped on the aluminum plate or coated conductive liquid rubber was placed on the aforesaid base plate 40, the power supply 43 was connected to the aluminum plate and experiment was carried out.

Platen (C):

This is a platen in which either a metallic thin film or thin film of metal oxide is formed at the surface of a glass plate having a size of 100 mm×100 mm and a thickness of 1 mm as shown in FIG. 29(B), wherein this thin film is of metallic aluminum and ITO (Indium Tin Oxide) having a thickness of 1 μm, this film was placed on the aforesaid base plate 40, the power supply 43 was connected to it and the experiment was carried out. Table 3 indicates a result of the experiment.

TABLE 3A (A) Platen of Metallic Single Structure

| Test No. | Structure of Platen (common item) Flat Plate Type 100 mm × 100 mm | Material of Layer Contacted with a Recording Medium: Volume resistivity (Ω · cm) | Material of Layer Contacted with a Recording Medium: Heat conductivity ($W \cdot m^{-1} \cdot K^{-1}$) | Coloring State of a Recording Medium Contacted with a Platen |
|---|---|---|---|---|
| 12 | Aluminum plate (thickness of 1 mm) | (Metallic aluminum) $3 \times 10^{-3}$ | 240 | Lean |
| 13 | Aluminum foil (thickness of 50 μm) | (Metallic aluminum) $3 \times 10^{-3}$ | 240 | Lean |
| 14 | Aluminum foil (thickness of 17 μm) | (Metallic aluminum) $3 \times 10^{-3}$ | 240 | slightly lean |
| 15 | Stainless steel plate (thickness of 1 mm) | (SUS304) $50 \times 10^{-3}$ | 15 | Slightly lean |

TABLE 3B (B) Platen of Double-layer Structure in Which Metal and Conductive Material Other Than Metal Are Combined

| Test No. | Structure of Platen (common item) Flat Plate Type 100 mm × 100 mm | Material of Layer Contacted with a Recording Medium: Volume Resistivity (Ω · cm) | Material of Layer Contacted with a Recording Medium: Heat Conductivity ($W \cdot m^{-1} \cdot K^{-1}$) | Coloring State of a Recording Medium Contacted with a Platen |
|---|---|---|---|---|
| 16 | Conductive rubber plate (thickness of 1.9 mm) is overlapped on an aluminum plate (thickness of 1 mm) | (Conductive rubber) 4.5 | 0.1 to 0.2 | Good |

TABLE 3B-continued (B) Platen of Double-layer Structure in Which Metal and Conductive Material Other Than Metal Are Combined

| Test No. | Structure of Platen (common item) Flat Plate Type 100 mm × 100 mm | Material of Layer Contacted with a Recording Medium: Volume Resistivity (Ω · cm) | Material of Layer Contacted with a Recording Medium: Heat Conductivity (W · m$^{-1}$ · K$^{-1}$) | Coloring State of a Recording Medium: Contacted with a Platen |
|---|---|---|---|---|
| 17 | Conductive rubber layer (thickness of 90 μm) is coated on an aluminum plate (thickness of 1 mm) | (Conductive rubber) 4.5 | 0.1 to 0.2 | Good |
| 18 | Conductive rubber layer (thickness of 30 μm) is coated on an aluminum plate (thickness of 1 mm) | (Conductive rubber) 4.5 | 0.1 to 0.2 | Good |
| 19 | Conductive sheet (thickness of 0.22 mm) is overlapped on an aluminum plate (thickness of 1 mm) Conductive sheet: Paper prepared by mixing Ni plated cellulose | (Conductive sheet) $4.6 \times 10^{-2}$ | 0.05 to 0.1 | Good |
| 20 | Conductive sheet (thickness of 0.23 mm) is overlapped on an aluminum plate (thickness of 1 mm) Conductive cloth: Cloth with Ni plated on acrylic fiber | (Conductive sheet) $1.1 \times 10^{-3}$ | 0.2 to 0.3 | Good |

TABLE 3C (C) Platen in Which a Thin Film of Metal Or Metal Oxide Is Stacked at the Surface of the Heat Insulating Material

| Test No. | Structure of Platen (common item) Flat Plate Type 100 mm × 100 mm | Material of Layer Contacted with a Recording Medium: Volume Resistivity (Ω · cm) | Material of Layer Contacted with a Recording Medium: Heat Conductivity (W · m$^{-1}$ · K$^{-1}$) | Coloring State of a Recording Medium: Contacted with a Platen |
|---|---|---|---|---|
| 21 | Thin film of metallic aluminum (thickness of 1 μm) is stacked on a glass plate (thickness of 1 mm) | (Metallic aluminum) $3 \times 10^{-6}$ | 240 | Good |
| 22 | Thin film of ITO (thickness of 0.1 μm) is stacked on a glass plate (thickness of 1 mm) | ITO (Indium Tin Oxide) $1.6 \times 10^{-4}$ | 12 | Good |

An observation attained in reference to Table 3 will be described as follows. As a reason why a generated color in the thermo-sensitive coloring sheet contacted with the common electrode 33 is lean in regard to the second coloring sheet when the platen (A) is used, it is estimated that since metal has a high heat conductivity, heat generated in the third thermo-sensitive coloring sheet contacted with the metal is absorbed by the common electrode 33. In the case of aluminum with the aforesaid heat conductivity being 230 to 240 W·m$^{-1}$·K$^{-1}$, even if foil having a thickness of 17 μm was used, a remarkable improvement could not be found. Although a slight improvement was found in the result of experiment in the stainless steel in metal having a low heat conductivity (approximately 15 W·m$^{-1}$·K$^{-1}$ for SUS304), a sufficient level could not be reached.

On the contrary, in the case of the platen (B), a conductive layer contacted with the conductive recording media 31 at the surface of the aluminum plate is made of material other than metal and all the heat conductivities of the materials constituting the conductive layer are less than 1 W·m$^{-1}$·K$^{-1}$ and the values are less than that of metal by 1 to 3 digits, resulting in that it is estimated that heat generated in the conductive thermo-sensitive sheet is restricted from being flowed out toward the platen 37. In the experiment in which the platen 37 having liquid conductive rubber coated on and dried at the aluminum plate was used, a superior coloring was generated even if a coating thickness was thinned down to 30 μm.

In turn, in the case of platen (C), since the conductive layer contacted with the conductive recording media 31 formed at the surface of the glass plate is of a thin film of metal or metal oxide and its heat conduction is high, although due to its thin film of thickness of 1 μm, it has a low heat capacity and further since a heat conduction in a direction of film surface is low, it is estimated that heat generated in the conductive recording media 31 is restricted from being transmitted and spread through the conductive layer.

Figure 30:
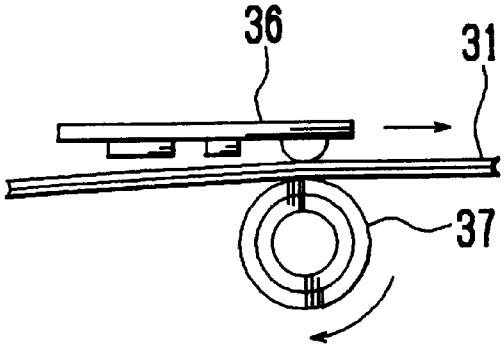
FIG. 30 is a side elevational view for showing a printer used in an experiment.

FIG. 30 is a configuration view for showing a major part of a practical recording device in reference to an observation attained by the foregoing fundamental experiment. Reference numeral 31 denotes a plurality of overlapped conductive recording media in which three sheets are overlapped. The plurality of overlapped conductive recording media 31 are held by the conductive type recording head 36 contacted with the upper surface and the roller type platen 37 contacted with the lower surface, the conductive recording media 31 are transported in a direction of arrow while they are being contacted with the recording head 36 under a rotation of the platen 37, electrical energization is applied between the recording head 36 and the platen 37 in correspondence with character signals or image signals, thereby a desired copied record can be attained in the conductive recording media 31.

Figure 31A:
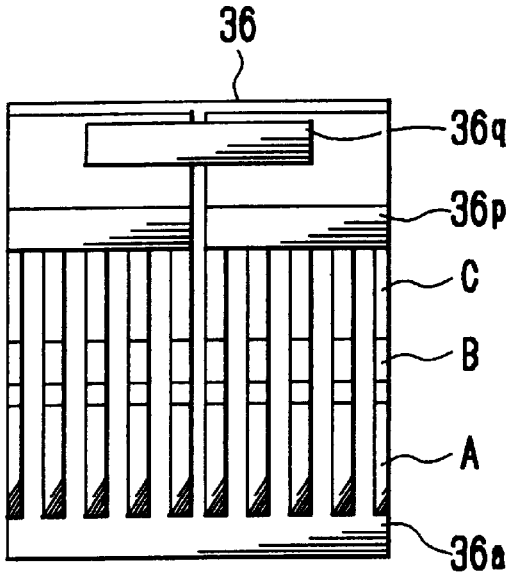
FIG. 31 is an illustrative view for showing an electrical energization head, wherein (A) is a top plan view, (B) is a side elevational view and (C) is a partial enlarged side elevational view.
Figure 31B:
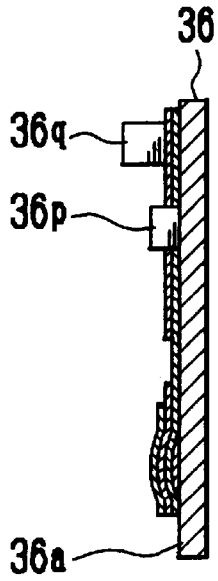
Figure 31C:
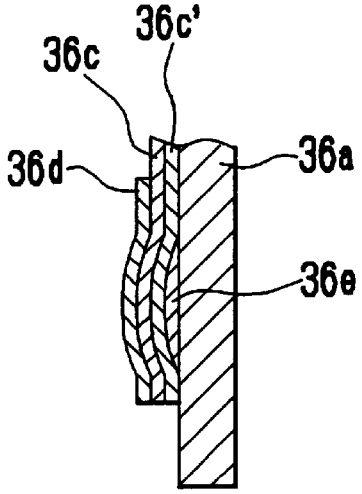

FIG. 31 shows a preferred embodiment of the conductive type recording head 36, wherein at first, a part A forming the separate electrodes 32 at the surface of an aluminum substrate 36*a* is formed with a column-like glass grazed layer 36*e*, on it are overlapped in sequence a thin film 36*c*' of metal oxide (for example, $TaSiO_2$) having high volume resistivity, a thin film 36*c* of metal having low volume resistivity (a small amount of Si, Cu is added to Al) and a thin film 36*d* of conductive material having a high anti-frictional characteristic (for example, Tix Ny). A film of three layers stacked from each other is divided into many band-shaped patterns by an etching process, wherein a part A near one end of the pattern becomes a group of separate electrodes 32, there is a part B at an intermediate section with only the thin film 36*c*' of metal oxide in the lower-most layer being left by a selective etching process, a part C having the anti-wearing layer 36*d* at the other end is connected to a group of control switches 34 for turning ON-OFF an electrical energization for the group of separate electrodes 32 and a LSI chip 36*p* having a circuit for controlling the group of controlling switches 34 integrated therein, and further this LSI chip is connected to one electrode of the power supply 43 for electrical energization through a connector 36*q* for an external connection. The part B having a high resistance at an intermediate section of the aforesaid band-like pattern contributes to stabilization of the recording of energization and the protection of circuit.

Figure 32A:
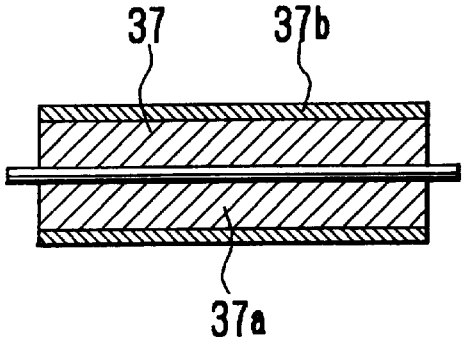
FIG. 32 is an illustrative view for showing a platen, wherein (A) is a side elevational view in longitudinal section and (B) is a front elevational view.
Figure 32B:
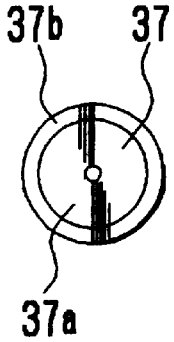

FIG. 32 shows a preferred embodiment of the roller-like platen 37 having a function of the common electrode 33 and a transporting function of the conductive recording media 31, wherein a conductive butyl rubber layer 37*b*' added with graphite is formed at the surface of the metallic column-like axial section 37*a*. The column-like axial section 37*a* is connected to an electrode of the power supply 35 for an energization recording which is opposite to the recording head 36.

As a result of trial operation of a plurality of overlapped copying and recording with the conduction recording device having the foregoing configuration, it shows that since the separate electrodes 32 of the recording head 36 are formed by a thin film, heat from the first conductive recording media 31 contacted with the film is absorbed in less amount, coloring is also superior and in addition, since the outer circumferential surface of the common electrode 33 at the platen 37 is formed by conductive rubber having a low heat conduction, heat absorption from the conductive recording media 31 was less and its coloring was also superior.

The present invention may be embodied in order specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other and volume resistivities of each of said conductive recording media are substantially the same to each other; and applying electricity between said separate electrodes and said common electrode.

2. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other and volume resistivities of each of said conductive recording media decreases toward said common electrode; and applying electricity between said separate electrodes and said common electrode.

3. A non-impact recording method according to claim 1, wherein each of said conductive recording media is of a double-layered structure in which each of said conductive recording media forms a conductive thermo-sensitive color generating layer at a surface of a conductive substrate and volumetric resistivity of said conductive substrate and volume resistivity of said conductive thermo-sensitive color generating layer are approximately the same to each other.

4. A non-impact recording method according to claim 2, wherein each of said conductive recording media comprises a double-layered structure in which each of said conductive recording media forms a conductive thermo-sensitive color generating layer at a surface of a conductive substrate and a volumetric resistivity of said conductive substrate and a volume resistivity of said conductive thermo-sensitive color generating layer are approximately the same to each other.

5. A non-impact recording method according to claim 1, wherein each of said conductive recording media comprises a single-layered structure in which a conductive characteristic and a thermo-sensitive color generating characteristic are uniformly applied to an inner layer part of a substrate.

6. A non-impact recording method according to claim 2, wherein each of said conductive recording media comprises a single-layered structure in which a conductive characteristic and a thermo-sensitive color generating characteristic are uniformly applied to an inner layer part of a substrate.

7. A non-impact recording method according to claim 1, wherein each of said conductive recording media comprises a three-layered structure in which a conductive thermo-sensitive color generating layer is formed at a front surface of a conductive substrate and a conductive thermo-sensitive fusing ink layer is formed at a rear surface of said conductive substrate, wherein volume resistivities of said conductive substrate, said conductive thermo-sensitive color generating layer, and said conductive thermo-sensitive fusing ink layer are substantially the same.

8. A non-impact recording method according to claim 2, wherein each of said conductive recording media comprises a three-layered structure in which a conductive thermo-sensitive color generating layer is formed at a front surface of a conductive substrate and a conductive thermo-sensitive fusing ink layer is formed at a rear surface of said conductive substrate, wherein volume resistivities of said conductive substrate, said conductive thermo-sensitive color generating layer, and said conductive thermo-sensitive fusing ink layer are substantially the same.

9. A non-impact recording method according to claim 1, wherein each of said conductive recording media comprises a double-layered structure in which a conductive thermo-sensitive fusing ink layer is formed at a rear surface of a conductive substrate applied uniformly with a thermo-sensitive coloring characteristic to an inner layer part and a volume resistivity of said conductive substrate and a volume resistivity of said conductive thermo-sensitive fusing ink layer are substantially the same.

10. A non-impact recording method according to claim 2, wherein each of said conductive recording media comprises a double-layered structure in which a conductive thermo-sensitive fusing ink layer is formed at a rear surface of a conductive substrate applied uniformly with a thermo-sensitive coloring characteristic to an inner layer part and a volume resistivity of said conductive substrate and a volume resistivity of said conductive thermo-sensitive fusing ink layer are substantially the same.

11. A non-impact recording method according to claim 1, wherein each of said conductive recording media comprises a double-layered structure in which a conductive thermo-sensitive fusing ink layer is formed at a rear surface of a conductive substrate and a volume resistivity of said conductive substrate and a volume resistivity of said conductive thermo-sensitive fusing ink layer are substantially the same.

12. A non-impact recording method according to claim 2, wherein each of said conductive recording media comprises a double-layered structure in which a conductive thermo-sensitive fusing ink layer is formed at a rear surface of a conductive substrate and a volume resistivity of said conductive substrate and a volume resistivity of said conductive thermo-sensitive fusing ink layer are substantially the same.

13. A non-impact recording method according to claim 1, wherein each of said conductive recording media comprises a single-layered structure in which a conductive characteristic is uniformly applied to an inner layer of a substrate.

14. A non-impact recording method according to claim 2, wherein each of said conductive recording media comprises a single-layered structure in which a conductive characteristic is uniformly applied to an inner layer of a substrate.

15. A non-impact recording method according to any one of claims 3, 4, 5, 6, 7, 8, 9, 10, 11, 12, 13 or 14 wherein an absolute value of volume resistivity of each of said conductive recording media is in a range of order of $10^{-2}$ to $10^{2}$ Ω·cm.

16. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other, said separate electrodes contacted with said overlapped conductive recording media are formed by a plurality of conductive films which are electrically independent from each other; and applying electricity between said separate electrodes and said common electrode.

17. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other, said separate electrodes contacted with said overlapped conductive recording media are formed by dividing conductive films stacked on a surface of a metallic supporting member through electrical and thermal insulating layers into a plurality of segments; and applying electricity between said separate electrodes and said common electrode.

18. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other, said separate electrodes contacted with said overlapped conductive recording media are formed by dividing conductive films stacked on a surface of a supporting member having an electrical insulating characteristic and a thermal insulating characteristic into a plurality of segments; and applying electricity between said separate electrodes and said common electrode.

19. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other, said separate electrodes contacted with said overlapped conductive recording media are formed by a conductive film pattern stacked on a surface of a synthetic resin film, the synthetic resin film is adhered to a supporting mechanism member; and applying electricity between said separate electrodes and said common electrode.

20. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other, a plurality of separate electrodes contacted with said overlapped conductive recording media are formed by a conductive film pattern of divided conductive films on a surface of a synthetic resin film said synthetic resin film is adhered to a supporting mechanism member through a member having rubber resilience; and applying electricity between said separate electrodes and said common electrode.

21. A non-impact recording method according to any one of claims 16, 17, 18, 19 or 20, wherein anti-wearing conductive films which are electrically independent from each other are stacked on a part of a separate electrode formed by a conductive film pattern which is at least contacted with said conductive recording medium.

22. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other, said common electrode contacted with said overlapped conductive recording media is formed by conductive material having a volume resistivity lower than a volume resistivity of said conductive recording medium contacted with said common electrode; and applying electricity between said separate electrodes and said common electrode.

23. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other, said common electrode contacted with said overlapped conductive recording media is formed by conductive material whose volume resistivity is lower than a volume resistivity of said conductive recording medium contacted with said common electrode and whose heat conductivity is not more than 1 $W \cdot m^{-1} \cdot K^{-1}$; and applying electricity between said separate electrodes and said common electrode.

24. A non-impact recording method, a recording image is formed on a conductive recording medium by heat energy, comprising the steps of:

bringing said conductive recording tedium into contact between separate electrodes and a common electrode, wherein said conductive recording medium comprises a plurality of conductive recording media to be overlapped with each other, said common electrode contacted with said overlapped conductive recording media is formed on a surface of a supporting mechanism member by a conductive layer whose volumetric resistivity is lower than a volume resistivity of said conductive recording medium contacted with said common electrode and whose heat conductivity is not more than 1 $W \cdot m^{-1} \cdot K^{-1}$; and applying electricity between said separate electrodes and said common electrode.

25. A non-impact recording method according to claim 24, wherein said conductive layer a conductive rubber.

26. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media to be overlapped with each other, said common electrode contacted with said overlapped conductive recording media is formed on a surface of a supporting mechanism member by a conductive film whose volume resistivity is lower than that of said conductive thermo-sensitive recording medium contacted with said common electrode through a thermal insulating layer having a heat conductivity not more than 1 $W \cdot m^{-1} \cdot K^{-1}$; and applying electricity between said separate electrodes and said common electrode.

27. A non-impact recording method according to claim 26, wherein said thermal insulating layer comprises a material having rubber resilience.

28. A non-impact recording method, a recording image is formed on a conductive recording medium by heat energy, comprising the steps of:

bringing said conductive recording medium into contact between separate electrodes and a common electrode, wherein said conductive recording medium comprises a plurality of conductive recording media overlapped with each other, either a single or a plurality of separate electrodes contacted with a side of said overlapped conductive recording media are transferred along said conductive recording media while said common electrode are being press contacted with an opposite side of said conductive recording media; and applying electricity between said separate electrodes and said common electrode.

29. A non-impact recording method, a recording image is formed on a conductive recording medium by heat energy, comprising the steps of:

bringing said conductive recording medium into contact between separate electrodes and a common electrode, wherein said conductive recording medium comprises a plurality of said conductive recording media overlapped with each other, said common electrode contacted with a surface of said overlapped conductive recording media move said conductive recording medium while said separate electrodes are being press contacted with an opposite side of said conductive recording medium; and applying electricity between said separate electrodes and said common electrode.

30. A conductive recording medium, comprising:

a plurality of conductive recording sheets, wherein volume resistivities of each of said conductive recording sheets are substantially the same; and means for combining a plurality of said conductive recording sheets to be overlapped with each other.

31. A conductive recording medium, comprising:

a plurality of conductive recording sheets, wherein volume resistivities of each of said conductive recording sheets are different; and means for combining a plurality of said conductive recording sheets to be overlapped with each other as volume resistivities of each of said overlapped conductive recording sheets are decreased.

32. A conductive recording medium according to claim 31, wherein each of said conductive recording sheets comprises a double-layered structure including a conductive thermo-sensitive color generating layer at a surface of a conductive substrate, and a volumetric resistivity of said conductive substrate and a volume resistivity of said conductive thermo-sensitive color generating layer are approximately the same.

33. A conductive recording medium according to claim 32, wherein each of said conductive recording sheets comprises a double-layered structure including a conductive thermo-sensitive color generating layer at a surface of a conductive substrate, and a volumetric resistivity of said conductive substrate and a volume resistivity of said conductive thermo-sensitive color generating layer are approximately the same.

34. A conductive recording medium according to claim 31, wherein each of said conductive recording sheets comprises a single-layered structure in which a conductive characteristic and a thermo-sensitive color generating characteristic are uniformly applied to an inner layer part of a substrate.

35. A conductive recording medium according to claim 32, wherein each of said conductive recording sheets comprises a single-layered structure in which a conductive characteristic and a thermo-sensitive color generating characteristic are uniformly applied to an inner layer part of a substrate.

36. A conductive recording medium according to claim 31, wherein each of said conductive recording sheets comprises a three-layered structure in which a conductive thermo-sensitive color generating layer is formed at a front surface of a conductive substrate and a conductive thermo-sensitive fusing ink layer is formed at a rear surface of said conductive substrate, wherein volume resistivities of said conductive substrate, said conductive thermo-sensitive color generating layer, and said conductive thermo-sensitive fusing ink layer are substantially the same.

37. A conductive recording medium according to claim 32, wherein each of said conductive recording sheets comprises a three-layered structure in which a conductive thermo-sensitive color generating layer is formed at a front surface of a conductive substrate and a conductive thermo-sensitive fusing ink layer is formed at a rear surface of said conductive substrate, wherein volume resistivities of said conductive substrate, said conductive thermo-sensitive color generating layer, and said conductive thermo-sensitive fusing ink layer are substantially the same.

38. A conductive recording medium according to claim 31, wherein each of said conductive recording sheets comprises a double-layered structure in which a conductive thermo-sensitive fusing ink layer is formed at a rear surface of a conductive substrate applied uniformly with a thermo-sensitive coloring characteristic to an inner layer part and a volume resistivity of said conductive substrate and a volume resistivity of said conductive thermo-sensitive fusing ink layer are substantially the same.

39. A conductive recording medium according to claim 32, wherein each of said conductive recording sheets comprises a double-layered structure in which a conductive thermo-sensitive fusing ink layer is formed at a rear surface of a conductive substrate applied uniformly with a thermo-sensitive coloring characteristic to an inner layer part and a volume resistivity of said conductive substrate and a volume resistivity of said conductive thermo-sensitive fusing ink layer are substantially the same.

40. A conductive recording medium according to claim 31, wherein each of said conductive recording sheets comprises a double-layered structure in which a conductive thermo-sensitive fusing ink layer is formed at a rear surface of a conductive substrate and a volume resistivity of said conductive substrate and a volume resistivity of said conductive thermo-sensitive fusing ink layer are substantially the same.

41. A conductive recording medium according to claim 32, wherein each of said conductive recording sheets comprises a double-layered structure in which a conductive thermo-sensitive fusing ink layer is formed at the rear surface of a conductive substrate and a volume resistivity of said conductive substrate and a volume resistivity of said conductive thermo-sensitive fusing ink layer are substantially the same.

42. A conductive recording medium according to claim 31, wherein each of said conductive recording sheets comprises a single-layered structure in which a conductive characteristic is uniformly applied to an inner layer of a substrate.

43. A conductive recording medium according to claim 32, wherein each of said conductive recording sheets comprises a single-layered structure in which a conductive characteristic is uniformly applied to an inner layer of a substrate.

44. A conductive recording medium according to claims 32, 33, 34, 35, 36, 37, 38, 39, 40, 41, or 42, wherein an absolute value of a volume resistivity of each of said conductive recording sheets is in a range on the order of $10^{-2}$ to $10^{2}$ Ω·cm.

* * * * *